US010564584B2

(12) United States Patent
Ogata et al.

(10) Patent No.: US 10,564,584 B2
(45) Date of Patent: Feb. 18, 2020

(54) SHEET-CONVEYING DEVICE, IMAGE-FORMING APPARATUS, AND IMAGE-READING APPARATUS

(71) Applicant: CANON KABUSHIKI KAISHA, Tokyo (JP)

(72) Inventors: Atsushi Ogata, Mishima (JP); Motohiro Furusawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/129,450

(22) Filed: Sep. 12, 2018

(65) Prior Publication Data

US 2019/0064722 A1 Feb. 28, 2019

Related U.S. Application Data

(63) Continuation of application No. PCT/JP2017/011707, filed on Mar. 23, 2017.

(30) Foreign Application Priority Data

Mar. 28, 2016 (JP) ..... 2016-064712
Feb. 20, 2017 (JP) ..... 2017-029503

(51) Int. Cl.

| | |
|---|---|
| ***G03G 15/00*** | (2006.01) |
| ***B65H 5/06*** | (2006.01) |
| ***G03G 15/02*** | (2006.01) |
| ***G03G 15/16*** | (2006.01) |

(52) U.S. Cl.

CPC ..... *G03G 15/602* (2013.01); *B65H 5/062* (2013.01); *G03G 15/0208* (2013.01); *G03G 15/1615* (2013.01)

(58) Field of Classification Search

CPC .... G03G 15/23; G03G 15/231; G03G 15/234; G03G 15/6552; G03G 2215/0043

See application file for complete search history.

(56) References Cited

FOREIGN PATENT DOCUMENTS

| | | | |
|---|---|---|---|
| JP | 08-268618 | A | 10/1996 |
| JP | 08-277052 | A | 10/1996 |
| JP | 2002128354 | A | 5/2002 |

(Continued)

OTHER PUBLICATIONS

Onaka (JP 2002-128354 A), May 2002, JPO Computer Translation (Year: 2002).*

*Primary Examiner* — Erika J Villaluna

(74) *Attorney, Agent, or Firm* — Canon U.S.A., Inc. IP Division

(57) ABSTRACT

A sheet-conveying device includes first, second, and third rotary members, and a switching unit. The first rotary member rotates in one direction to convey, with the second rotary member, a sheet in a first direction and to convey, with the third rotary member, the sheet in a second direction. The switching unit switch from a first to a second state by moving the first rotary member before a trailing end of the first direction conveyed sheet passes through the first and second rotary members. The first state is a state where the second rotary member contacts a first surface of the sheet and the first rotary member contacts a second surface of the sheet. The second state is a state where the first rotary member contacts with the first surface of the sheet and the third rotary member contacts the second surface of the sheet.

28 Claims, 25 Drawing Sheets

(56) References Cited

FOREIGN PATENT DOCUMENTS

| | | | |
|---|---|---|---|
| JP | 2008037579 | A | 2/2008 |
| JP | 2009155097 | A | 7/2009 |
| JP | 2015083353 | A | 4/2015 |

* cited by examiner

SHEET-CONVEYING DEVICE, IMAGE-FORMING APPARATUS, AND IMAGE-READING APPARATUS

CROSS-REFERENCE TO RELATED APPLICATIONS

This application is a Continuation of International Patent Application No. PCT/JP2017/011707, filed Mar. 23, 2017, which claims the benefit of Japanese Patent Application No. 2016-064712, filed Mar. 28, 2016 and No. 2017-029503, filed Feb. 20, 2017, both of which are hereby incorporated by reference herein in their entirety.

TECHNICAL FIELD

The present invention relates to a sheet-conveying device that continuously conveys sheets, an image-forming apparatus such as a copying machine, a printer, or a facsimile that includes the sheet-conveying device, and an image-reading apparatus.

BACKGROUND ART

In recent years, there is a need for an image-forming apparatus that enables resources to be further saved, and duplex printing is frequently performed on sheets such as a blank form, an OHP sheet, a plastic sheet, and cloth. Accordingly, it is important for an image-forming apparatus that has a duplex printing function to increase the number of sheets on which duplex printing can be performed per unit time, that is, to have an improved productivity of duplex printing.

PTL 1 discloses the related art in which a reversing portion at which a sheet is reversed includes a reverse roller group that includes a drive roller that rotates in only one direction when the drive roller is subjected to a driving force, a first driven roller, and a second driven roller. The first driven roller, the drive roller, and the second driven roller of the reverse roller group are arranged in this order in a substantially straight line in a direction that intersects a direction in which the sheet is conveyed. The first driven roller faces the drive roller and forms a first nip portion. The second driven roller faces the drive roller, is on the opposite side of the drive roller from the first driven roller, and forms a second nip portion.

In PTL 1, at the reversing portion, the sheet is reversed in the following manner. An image is formed on a first surface of the sheet, and the sheet is conveyed toward the first nip portion of the reverse roller group. Subsequently, at the first nip portion, the sheet is conveyed in a first direction in which the sheet is discharged from the reverse roller group. A trailing end of the sheet in the direction in which the sheet is conveyed passes through the first nip portion. The reversing portion includes a switch back portion that temporarily receives the sheet on the downstream side of the first nip portion in the direction in which the sheet is conveyed. The sheet that passes through the first nip portion is received by the switch back portion. Subsequently, the sheet that is temporarily received by the switch back portion falls due to the weight of the sheet, and the trailing end of the sheet is guided to the second nip portion of the reverse roller group. Since the drive roller rotates in only one direction, the sheet that is nipped at the second nip portion is conveyed in a second direction opposite the first direction in which the sheet is conveyed at the first nip portion. Subsequently, the sheet is conveyed to an image-forming unit again, and an image is formed on a second surface of the sheet. Subsequently, the sheet is conveyed to a sheet-discharging unit that is disposed at a position that differs from that of the reversing portion. The sheet discharged from the image-forming apparatus by using a discharge roller of the sheet-discharging unit.

In PTL 1, the sheet is completely discharged from the reverse roller group to the switch back portion, the sheet is temporarily received by the switch back portion, and the nip portion at which the sheet is nipped is switched from the first nip portion to the second nip portion. In the case where duplex printing is continuously performed on sheets with this structure, while a first sheet that has passed through the first nip portion is received by the switch back portion, a subsequent second sheet can be conveyed to the first nip portion.

However, with the structure in PTL 1, in which the sheets are completely discharged from the first nip portion of the reverse roller group to reverse the sheets, it is necessary for the switch back portion that temporarily receives the sheets to be disposed on the downstream side of the reverse roller group in the direction in which the sheet is conveyed. In this case, since the sheet that is discharged from the reverse roller group is received by the switch back portion, it is necessary for the image-forming apparatus to include the sheet-discharging unit that discharges the sheet from the image-forming apparatus at the position that differs from that of the reversing portion that reverses the sheet. This makes a problem of an increase in the size of the image-forming apparatus.

CITATION LIST

Patent Literature

PTL 1: Japanese Patent Laid-Open No. 2015-083353

SUMMARY OF INVENTION

In view of this, it is an object of the present invention to provide a sheet-conveying device that enables the nip portion that nips the sheet to be switched before the trailing end of the sheet in the direction in which the sheet is conveyed completely passes through the first nip portion.

The present invention provides a sheet-conveying device including a first rotary member that rotates in one direction, a second rotary member that conveys a sheet in a first direction together with the first rotary member as a result of rotation of the first rotary member, a third rotary member that conveys the sheet in a second direction that differs from the first direction together with the first rotary member as a result of rotation of the first rotary member, and a switching unit that moves the first rotary member before a trailing end of the sheet that is conveyed in the first direction passes through the first rotary member and the second rotary member to switch from a first state in which the second rotary member is in contact with a first surface of the sheet and the first rotary member is in contact with a second surface of the sheet that is opposite the first surface to a second state in which the first rotary member is in contact with the first surface of the sheet and the third rotary member is in contact with the second surface of the sheet.

Further features of the present invention will become apparent from the following description of exemplary embodiments with reference to the attached drawings.

DESCRIPTION OF EMBODIMENTS

Preferred embodiments of the invention will hereinafter be described in detail by way of example with reference to the drawings. The following description gives an example of a laser beam printer that includes a sheet-conveying device according to each embodiment of the present invention. However, components according to the embodiments are described by way of example, and the scope of the invention is not limited to the components.

First Embodiment

Figure 1:
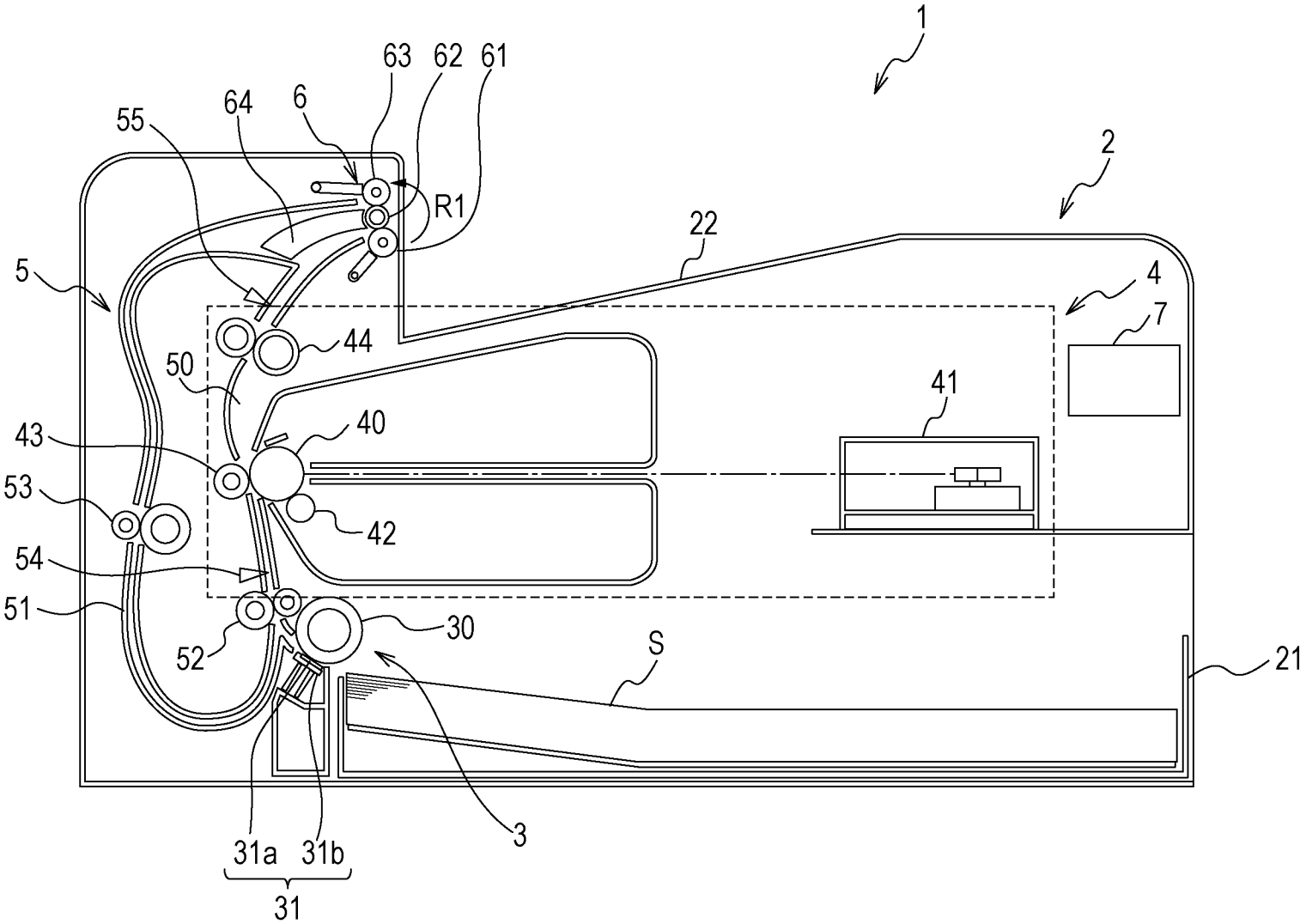
FIG. 1 is a schematic sectional view of an image-forming apparatus according to a first embodiment and illustrates the overall structure thereof.

FIG. 1 is a schematic sectional views of the structure of an image-forming apparatus 1 that includes a sheet-conveying device according to a first embodiment of the present invention. As illustrated in FIG. 1, the image-forming apparatus 1 includes a main body 2 of the image-forming apparatus 1, a feeding unit 3, an image-forming unit 4, a conveying unit 5, a reversing unit 6, and a control unit 7.

The main body 2 accommodates the feeding unit 3, the image-forming unit 4, the conveying unit 5, the reversing unit 6, and the control unit 7. A sheet feed cassette 21 that serves as a receiving unit is removably disposed on the upstream side of the feeding unit 3 in a direction in which a sheet is conveyed. Sheets S that are stacked thereon are fed to the feeding unit 3. A sheet discharge tray 22 that serves as a stack portion is disposed on the downstream side of the reversing unit 6 in the direction in which the sheet is conveyed. After image formation, each sheet S that is discharged from the main body 2 is stacked on the sheet discharge tray 22.

The feeding unit 3 includes a feed roller 30, and a separation unit 31 that includes a separation pad 31*a* and a separation holder 31*b* that holds the separation pad 31*a*. The separation pad 31*a* is pressed against the feed roller 30. The sheets S that are stacked on the sheet feed cassette 21 are fed to the separation unit 31 as a result of rotation of the feed roller 30, are separated one by one by the separation unit 31, and are subsequently fed to a first conveyance path 50.

The image-forming unit 4 includes a photosensitive drum 40 that serves as an image-bearing member, a laser scanner unit 41, a developing portion 42, a transfer roller 43, and a fixing portion 44. The photosensitive drum 40 is uniformly charged by a charging device not illustrated, and a laser beam is emitted from the laser scanner unit 41 toward the photosensitive drum 40 in accordance with image information to form an electrostatic latent image on a surface of the photosensitive drum 40. The developing portion 42 develops the electrostatic latent image to form a toner image on the surface of the photosensitive drum 40. The transfer roller 43 transfers the toner image that is developed to each sheet S. The fixing portion 44 heats and pressurizes the toner image and fixes the toner image on the sheet S. In this way, the image-forming unit 4 forms the image on the sheet S.

Figure 2:
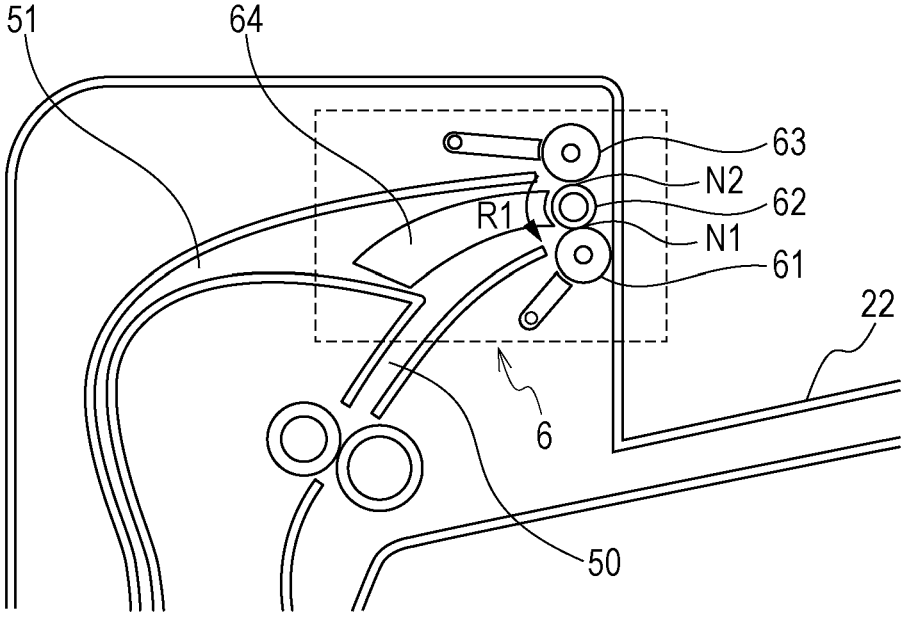
FIG. 2 is a schematic sectional view of a reversing unit according to the first embodiment.

FIG. 2 is a schematic sectional view of the structure of the reversing unit 6 according to the present embodiment. The structure of the reversing unit 6 will now be described with reference to FIG. 2. The reversing unit 6 includes a drive roller 62 (first rotary member) that rotates in only one direction (direction of an arrow R1 in FIG. 2) when the drive roller 62 is subjected to a driving force from a drive source, discharge rollers 61 (second rotary members), and reverse rollers 63 (third rotary members). Rotation of the drive roller 62 causes the discharge rollers 61 and the reverse rollers 63 to rotate.

The discharge rollers 61 are in contact with the drive roller 62 and form first nip portions N1. At the first nip portions N1, the discharge rollers 61 and the drive roller 62 nip the sheet S therebetween and convey the sheet S. The reverse rollers 63 are in contact with the drive roller 62 and form second nip portions N2 at positions that differ from those of the discharge rollers 61 in the circumferential direction of the drive roller 62. The reverse rollers 63 and the drive roller 62 nip the sheet S therebetween and convey the sheet S.

As a result of rotation of the drive roller 62, the drive roller 62 and the discharge rollers 61 convey the sheet S from the drive roller 62 toward the sheet discharge tray 22 and discharge the sheet S from the first nip portions N1. The direction in which the sheet S is discharged from the first nip portions N1 toward the sheet discharge tray 22 is referred to as a discharge direction (first direction). Since the drive roller 62 rotates in only one direction when being subjected to a driving force, the sheet S is conveyed from the sheet discharge tray 22 toward a second conveyance path 51 at the second nip portions N2 and is conveyed in a reverse direction (second direction) that differs from the direction in which the sheet S is conveyed at the first nip portions N1. The second direction is a direction in which the sheet S that is conveyed toward the sheet discharge tray 22 in the discharge direction is conveyed from the sheet discharge tray 22 toward the reversing unit 6.

That is, since the drive roller 62 rotates in only one direction (direction of the arrow R1 in FIG. 2), the sheet S is conveyed in the first direction at the first portions N1, and the sheet S is conveyed in the second direction opposite the first direction at the second nip portions N2. The reversing unit 6 moves the drive roller 62 to switch from a state in which the sheet S is nipped at the first nip portions N1 to a state in which the sheet S is nipped at the second nip portions N2. Operation of moving the drive roller 62 to switch between the states in which the sheet S is nipped will be described in detail later.

As illustrated in FIG. 1, the conveying unit 5 contains the first conveyance path 50 and the second conveyance path 51 and includes a pair of first conveyance rollers 52, a pair of second conveyance rollers 53, a first sensor 54, and a second sensor 55.

The first conveyance path 50 is a conveyance path via which the sheet S is conveyed to the image-forming unit 4 to form an image on the sheet S that is fed from the sheet feed cassette 21 or to form an image again on the sheet S after the reversing unit 6 conveys the sheet S in the reverse direction. The first conveyance path 50 on the downstream side in the direction in which the sheet S is conveyed is connected to the first nip portions N1 of the reversing unit 6. The first conveyance path 50 on the upstream side is bifurcated. A bifurcated part of the first conveyance path 50 is connected to the sheet feed cassette 21. The sheet S is fed from the sheet feed cassette 21 to the first conveyance path 50. The transfer roller 43 of the image-forming unit 4 transfers the toner image to the sheet S. The other bifurcated part of the first conveyance path 50 is connected to the second conveyance path 51. The second conveyance path 51 is a conveyance path via which the sheet S that is conveyed in the reverse direction by using the reversing unit 6 is conveyed to the first conveyance path 50 again. The second conveyance path 51 on the upstream side in the direction in which the sheet is conveyed is connected to the second nip portions N2 of the reversing unit 6. The second conveyance path 51 on the downstream side is connected to the other bifurcated part of the first conveyance path 50.

The pair of the first conveyance rollers 52 is disposed on the first conveyance path 50 and enables the sheet S that is fed or conveyed to the first conveyance path 50 to be conveyed along the first conveyance path 50. The pair of the second conveyance rollers 53 is disposed on the second conveyance path 51 and enables the sheet S that is conveyed on the second conveyance path 51 to be conveyed to the first conveyance path 50.

The first sensor 54 is disposed on the first conveyance path 50 between the feeding unit 3 and the image-forming unit 4 and detects the position of the leading end and trailing end of the sheet S that passes through the first sensor 54. The second sensor 55 is disposed on the downstream side of the first conveyance path 50 in the direction in which the sheet is conveyed and detects the position of the leading end and trailing end of the sheet S that passes through the second sensor 55 as in the first sensor 54. The first sensor 54 and the second sensor 55 according to the present embodiment are urged in the directions in which the first sensor 54 and the second sensor 55 come into contact with the sheet S. Each of the first sensor 54 and the second sensor 55 includes a sensor plug (not illustrated) that swings when the sheet S passes therethrough and a photointerrupter (not illustrated), which is an optical sensor. With this structure, the leading end and trailing end of the sheet can be detected in a manner in which the sensor plug is pushed, falls, and swings when the sheet S passes therethrough so as to close or open a region to be detected by the photointerrupter.

According to the present embodiment, each of the first sensor 54 and the second sensor 55 includes the sensor plug that swings when the sheet S passes therethrough. However, the sensors for detecting the leading end and trailing end of the sheet S are not limited thereto. For example, each of the first sensor 54 and the second sensor 55 can be an optical sensor that detects the presence or absence of the sheet S in a manner in which light is emitted from a light-emitting element toward the sheet S, and the light that passes through the sheet S or reflected light is received by a light-receiving element.

Reversing guides 64 guide the sheet S to be conveyed. Each reversing guide 64 guides the sheet S that is fed from the sheet feed cassette 21 to the first nip portions N1 and guides the sheet S that is conveyed in the second direction at the second nip portions N2 to the second conveyance path 51.

The control unit 7 can control drive related to conveyance of the sheet S such as drive of the feed roller 30, the pair of the first conveyance rollers 52, the pair of the second conveyance rollers 53, and the reversing unit 6 and control operation of the reversing unit 6 to move the drive roller 62.

The control of the operation of the reversing unit 6 by the control unit 7 will be described in detail later.

Figure 3A:
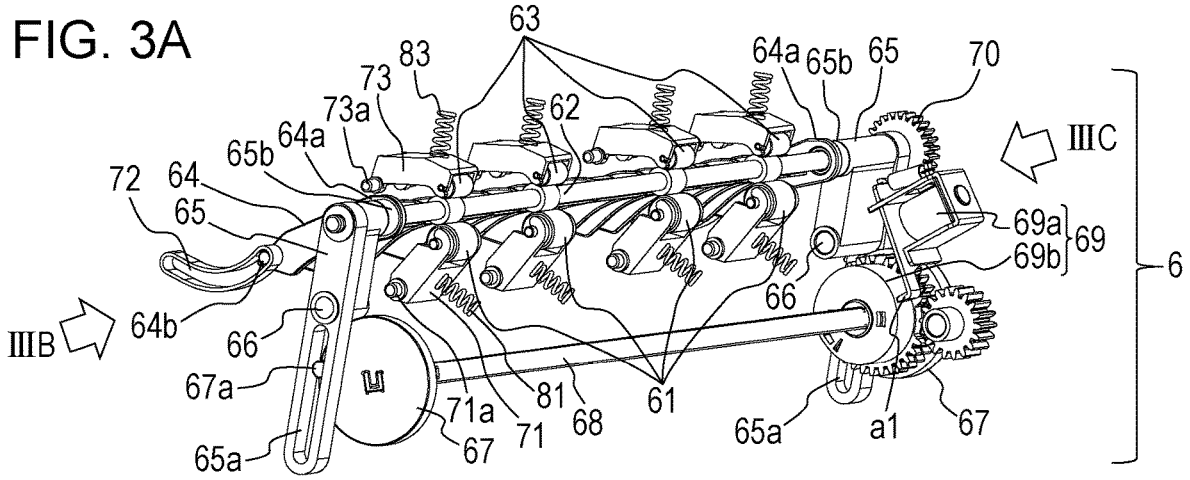
FIG. 3A schematically illustrates the structure of the reversing unit according to the first embodiment.
Figure 3B:
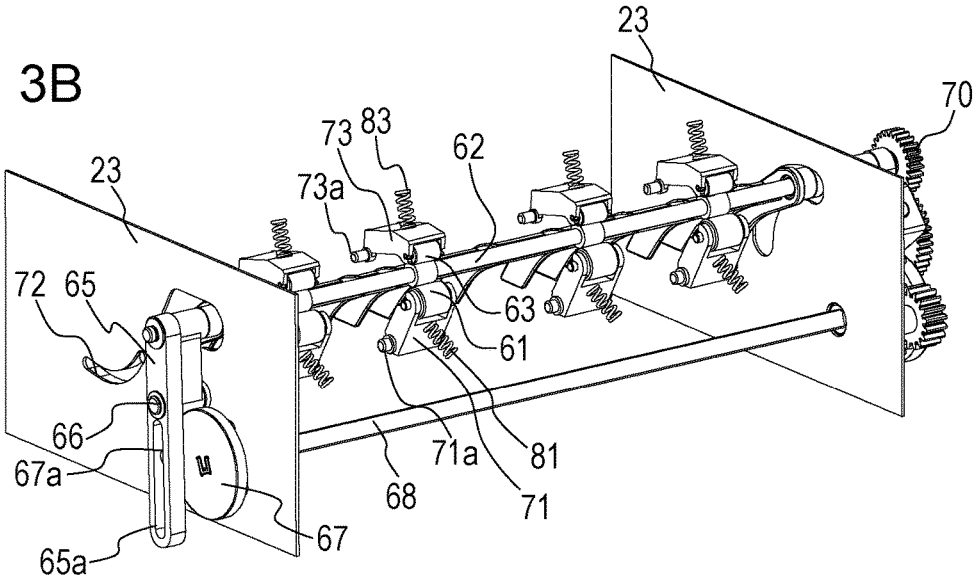
FIGS. 3B and 3C schematically illustrate the relationship between the reversing unit and a frame of a main body according to the first embodiment.
Figure 3C:
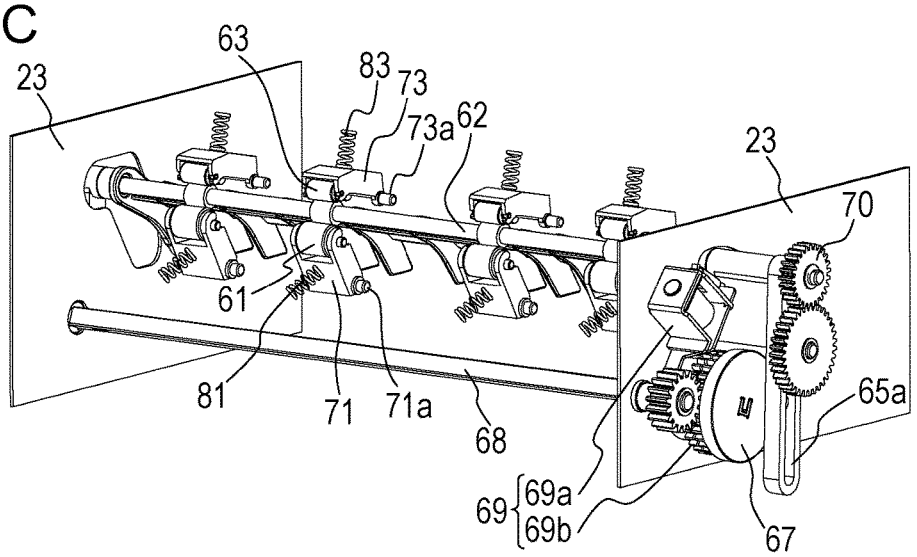
Figure 4:
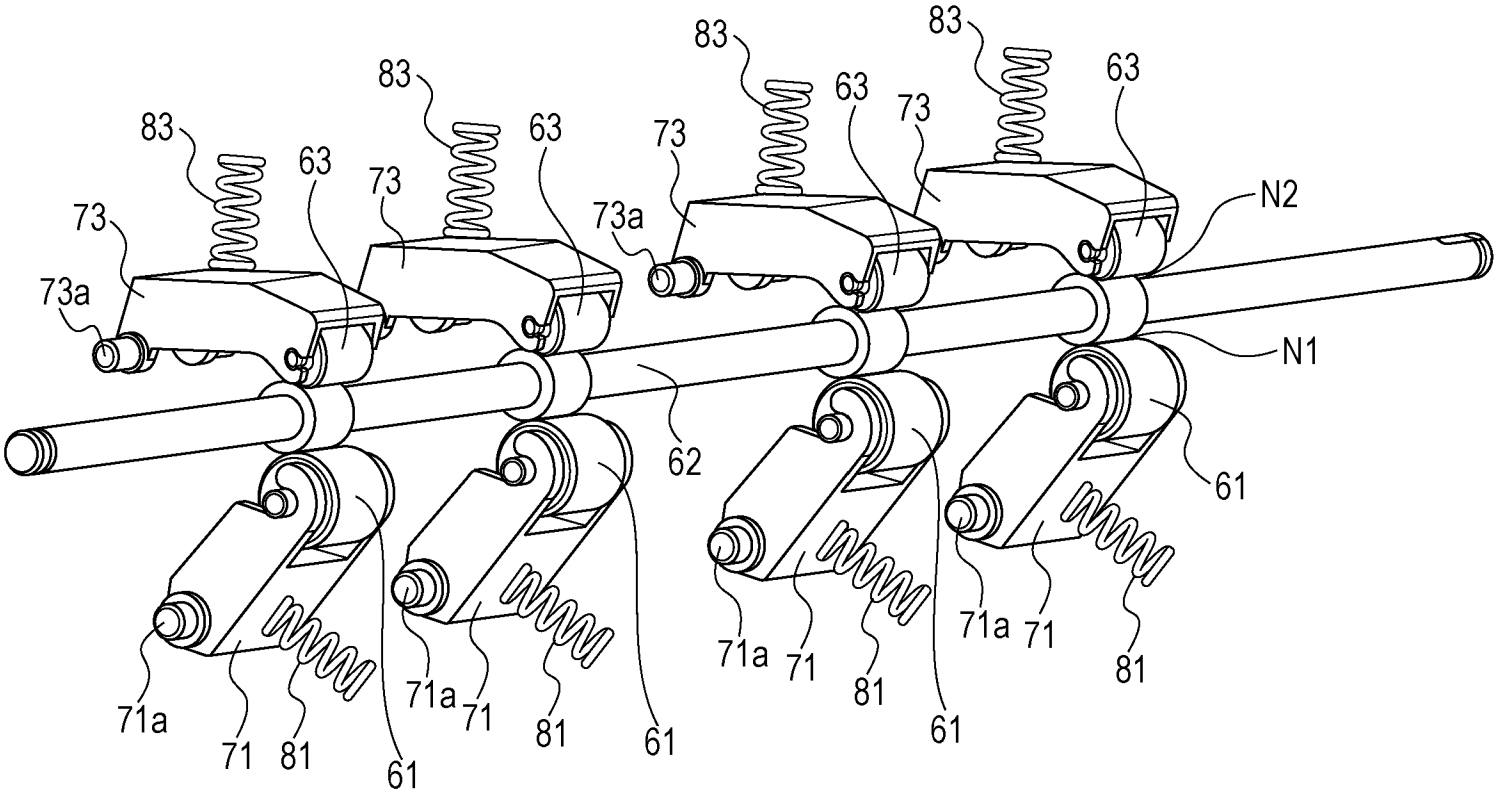
FIG. 4 schematically illustrates the structure of rotary members of the reversing unit according to the first embodiment.
Figure 5:
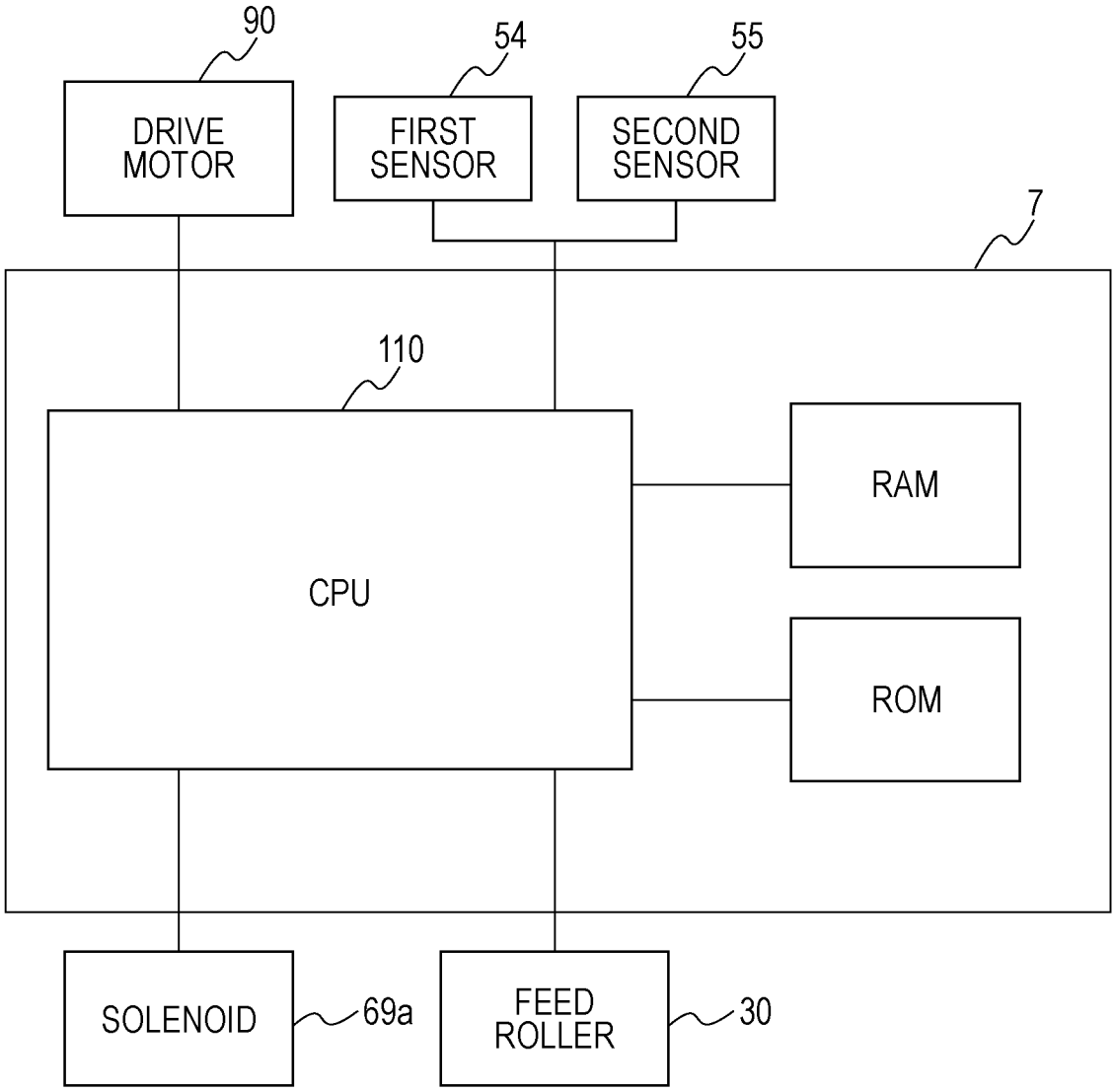
FIG. 5 is a block diagram according to the first embodiment.

The structure of the reversing unit 6 according to the present embodiment will now be described with reference to FIGS. 3A to 3C, FIG. 4, and FIG. 5. FIG. 3A schematically illustrates the structure of the reversing unit 6 according to the present embodiment viewed from the downstream side in the direction in which the sheet is conveyed. FIGS. 3B and 3C schematically illustrate the relationship of arrangement of a frame 23 of the main body 2 and the reversing unit 6 viewed from a direction of IIIB and a direction of IIIC in FIG. 3A. FIG. 4 schematically illustrates the structure of each discharge roller 61, the drive roller 62, and each reverse roller 63 according to the present embodiment. FIG. 5 is a block diagram illustrating control by the control unit 7 according to the present embodiment.

As illustrated in FIGS. 3B and 3C, the drive roller 62 of the reversing unit 6 is rotatably held by the frame 23 of the main body 2. As illustrated in FIG. 3A, both ends of the drive roller 62 are rotatably held by drive roller holders 65 that are swingable about respective fulcrums 66. The drive roller holders 65 hold the drive roller 62 at end portions thereof. Each of the other end portions on the opposite side of the fulcrums 66 has a guide groove 65*a*.

Cams 67 are rotatable, integrally formed with a cam shaft 68, and disposed on the frame 23 at both ends of the cam shaft 68 that faces the drive roller 62 and that is substantially parallel to the drive roller 62. Each cam 67 includes a cylindrical projection 67*a* on a surface that differs from a surface in contact with the cam shaft 68. The projections 67*a* are fitted in the respective guide grooves 65*a*, and the cams 67 are held by the respective drive roller holders 65. A cam-driving member 69 disposed near an end of the cam shaft 68. The cam-driving member 69 includes a solenoid 69*a* (switching member) and a partially toothless gear 69*b* and can switch on and off to rotate the cams 67. The cam-driving member 69 switches on and off to rotate the cams 67 in a manner in which a movable portion a1 of the solenoid 69*a* engages or disengages a partially toothless portion of the partially toothless gear 69*b*. According to the present embodiment, the partially toothless gear 69*b* and the movable portion a1 of the solenoid 69*a* are used as a clutch structure of the cam-driving member 69. The present invention, however, is not limited thereto. A typical clutch such as a spring clutch that uses the elasticity of a spring may be used.

As illustrated in FIG. 3A, the reversing guides 64 are supported by both end portions of the drive roller 62 in the axial direction of the drive roller 62. An end portion 64*a* of each reversing guide 64 that is supported by the drive roller 62 in the direction perpendicular to the axial direction of the drive roller 62 is held so as to be swingable by a bearing 65*b* of the corresponding drive roller holder 65. The other end portion of each reversing guide 64 that opposite the end portion 64*a* in the direction perpendicular to the axial direction of the drive roller 62 includes a cylindrical projection 64*b*. The projections 64*b* are arranged in the axial direction of the drive roller 62 at the other end portions of the reversing guides 64 and are fitted in respective grooves 72 that are formed in the frame 23 as illustrated in FIG. 3B. The grooves 72 are formed in the frame 23 on both sides in the axial direction of the drive roller 62.

As illustrated in FIG. 4, the discharge rollers 61 are in contact with the drive roller 62, form the first nip portions N1, and are held by respective discharge roller holders 71 that are swingable about fulcrums 71*a*. The discharge roller holders 71 are urged against the drive roller 62 by using respective springs 81 (first urging members) that are disposed on the main body 2. The drive roller 62 forms the first nip portions N1 with the drive roller 62 pressed by the discharge rollers 61.

The reverse rollers 63 are in contact with the drive roller 62, form the second nip portions N2, and are held by respective reverse roller holders 73 that are swingable about fulcrums 73*a*. The reverse roller holders 73 are urged against the drive roller 62 by using respective springs 83 (second urging members) that are disposed on the main body 2. The drive roller 62 forms the second nip portions N2 with the drive roller 62 pressed by the reverse rollers 63.

The block diagram in which drive is controlled according to the present embodiment will now be described with reference to FIG. 5. An end of the drive roller 62 is connected to a gear 70 and rotates when the drive roller 62 is subjected to a driving force from a drive motor 90 that serves as the drive source via the gear 70. The drive motor 90 rotates in only one direction. Also, the drive roller 62 rotates in only one direction. As illustrated in FIG. 5, a CPU 110 is connected to the drive motor 90, the solenoid 69*a*, the feed roller 30, the first sensor 54, and the second sensor 55. The CPU 110 is also connected to a ROM and a RAM and executes a program that is stored in the ROM with the RAM used as a work memory. According to the present embodiment, the control unit 7 includes the CPU 110, the ROM, and the RAM. According to the present embodiment, the control unit 7 controls the drive motor 90 and the solenoid 69*a* to cause the drive roller 62 of the reversing unit 6 to rotate and to cause the drive roller 62 to move by using the cam-driving member 69.

The operation of moving the drive roller 62 of the reversing unit 6 will now be described with reference to FIGS. 6A to 6C.

Figure 6A:
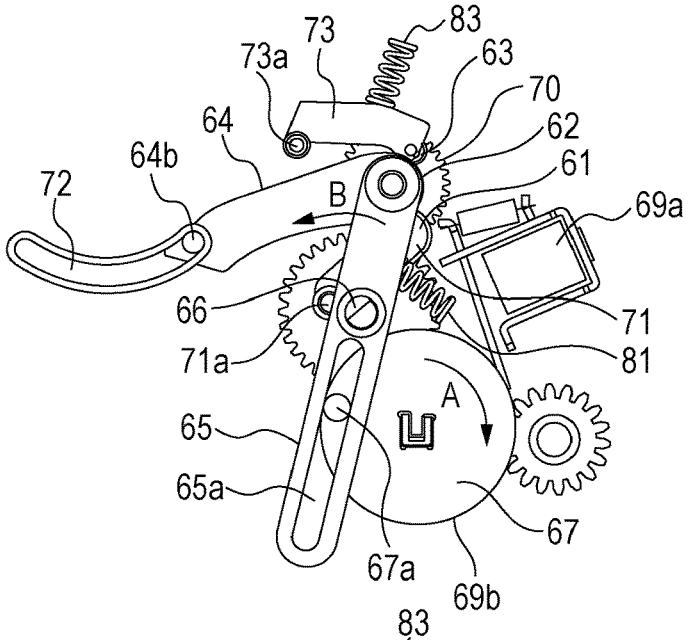
FIGS. 6A to 6C schematically illustrate the structure of the reversing unit and operation of a drive roller according to the first embodiment.

FIG. 6A schematically illustrates the reversing unit 6 viewed from the axial direction of the drive roller 62 before the drive roller 62 starts moving. In this state, the position of the drive roller 62 is regarded as an initial position (first position). The drive roller 62 rotates in one direction when being subjected to a driving force from the drive source at the initial position.

In the state in FIG. 6A, when the solenoid 69*a* is energized to unlock the partially toothless gear 69*b*, the driving force is transmitted to the partially toothless gear 69*b*, and the cams 67 rotate in the direction (clockwise direction) of an arrow A in FIG. 6A. At this time, rotation of the cams 67 causes the projections 67*a* that are fitted in the guide grooves 65*a* of the drive roller holders 65 to revolve in the direction (clockwise direction) of the arrow A in FIG. 6A. The drive roller holders 65 swing in the direction (counterclockwise direction) of an arrow B in FIG. 6A about the fulcrums 66. Consequently, the drive roller 62 both ends of which are held by the drive roller holders 65 moves in the direction (direction of the arrow B in FIG. 6A) in which the drive roller 62 is separated from the discharge rollers 61 and the reverse rollers 63. The reversing guides 64 are supported by both ends of the drive roller 62, and the end portions 64*a* of the reversing guides 64 are held by the drive roller holders 65. Accordingly, movement of the drive roller 62 causes the reversing guides 64 to move. The projections 64*b* of the reversing guides 64 are fitted in the grooves 72. Accordingly, the reversing guides 64 move along the grooves 72 while angles between the reversing guides 64 and the drive roller holders 65 change. At this time, the gear 70 that is connected to the end of the drive roller 62 also moves together with the drive roller 62, and the drive roller 62 rotates in one direction while moving when being subjected to a driving force from the drive motor 90 that serves as the drive source.

Figure 6B:
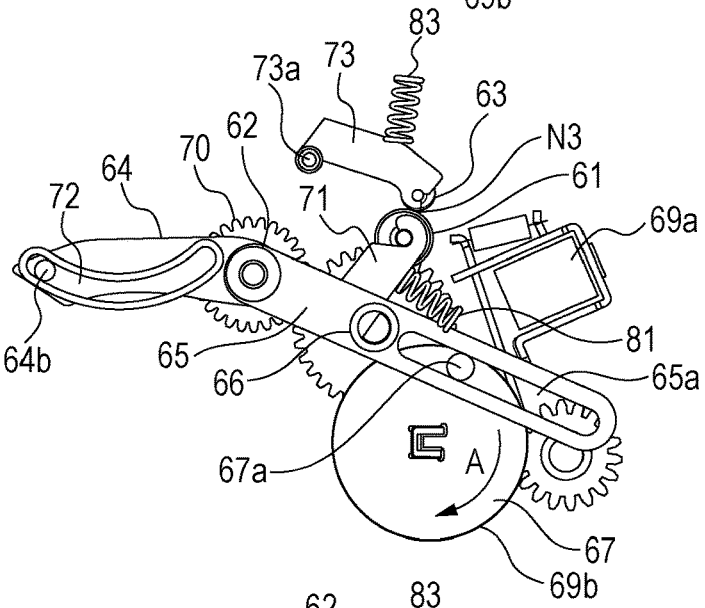

FIG. 6B schematically illustrates the reversing unit 6 viewed from the axial direction of the drive roller 62 after the drive roller 62 and the reversing guides 64 move as a result of rotation of the cams 67, and the drive roller 62 moves the maximum distance. At this time, the drive roller 62 is at a retracted position (second position) that is retracted from the initial position.

The discharge rollers 61 that are held by the discharge roller holders 71 are urged against the drive roller 62 by using the springs 81 that are disposed on the main body 2. As a result of movement of the drive roller 62, the discharge roller holders 71 swing about the fulcrums 71*a*, and the discharge rollers 61 move toward the reverse rollers 63.

The reverse rollers 63 that are held by the reverse roller holders 73 are urged against the drive roller 62 by using the springs 83 that are disposed on the main body 2. As a result of movement of the drive roller 62, the reverse roller holders 73 swing about the fulcrums 73*a*, and the reverse rollers 63 move toward the discharge rollers 61. An angle at which the discharge roller holders 71 swing is restricted within the position in FIG. 6B by using a restricting member not illustrated. Accordingly, the reverse rollers 63 move to the positions at which the reverse rollers 63 come into contact with the discharge rollers 61 that are at rest at the positions in FIG. 6B. Consequently, the reverse rollers 63 and the discharge rollers 61 come into contact with each other and form third nip portions N3 that serve as holding portions that can hold the sheet S to be conveyed while nipping the sheet S therebetween.

Figure 6C:
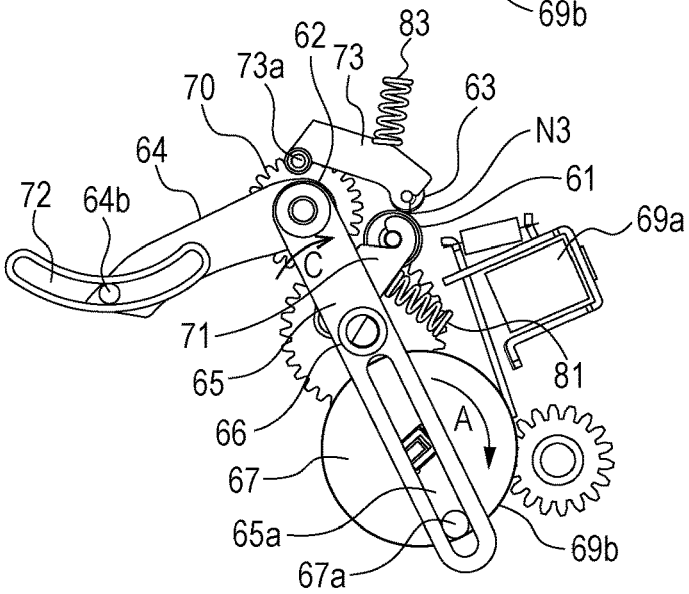

Subsequently, as illustrated in FIG. 6C, when the cams 67 further rotate in the direction (clockwise direction) of an arrow A in FIG. 6C, the drive roller holders 65 swing about the fulcrums 66 in the direction (clockwise direction) of an arrow C in FIG. 6C. Consequently, the reversing guides 64 move along the grooves 72 while being guided by the grooves 72. The drive roller 62 approaches the discharge rollers 61 and the reverse rollers 63 and moves from the retracted position to the initial position. When the projections 67*a* return to the position in FIG. 6A, transmission of the drive force to the partially toothless gear 69*b* is stopped, and the cams 67 stop rotating. At this time, the solenoid 69*a* is no longer energized. Accordingly, when the partially toothless gear 69*b* is locked, the cams 67 stop rotating. That is, a series of movement of the drive roller 62 of the reversing unit 6 occurs while the cam-driving member 69 causes the cams 67 to make one rotation. Since the drive roller 62 moves together with the gear 70, the drive roller 62 continues to rotate in one direction while being subjected to a driving force from the drive motor 90 via the gear 70 during the series of movement of the drive roller 62 with respect to the discharge rollers 61 and the reverse rollers 63.

Figure 7:
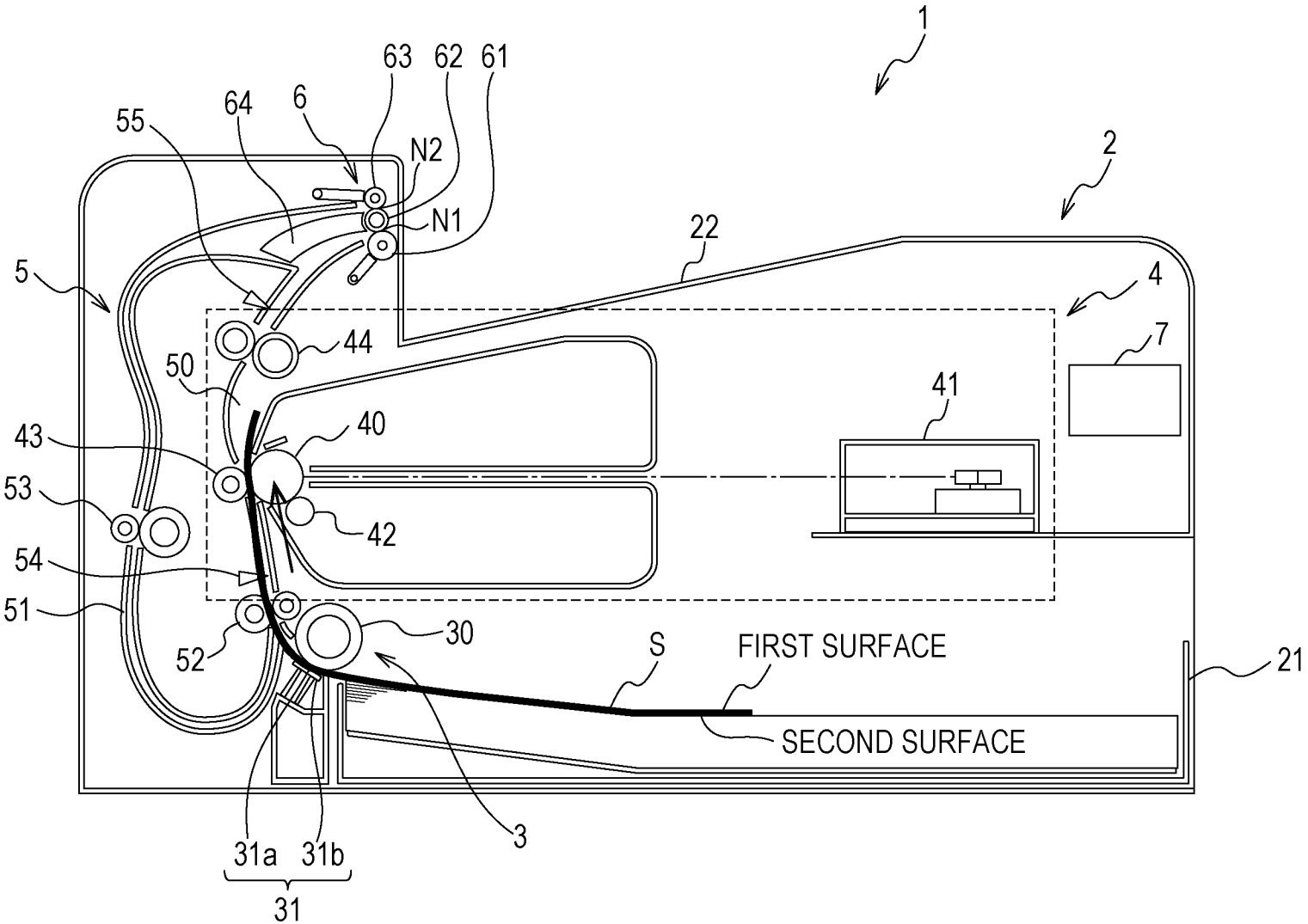
FIG. 7 illustrates operation of conveying a sheet when images are formed on both surfaces of the sheet according to the first embodiment with a schematic sectional view.

FIG. 7 illustrates a state after the feed roller 30 feeds the sheet S that is stacked on the sheet feed cassette 21 with a schematic sectional view. As illustrated in FIG. 7, the feed roller 30 takes the sheets S out of the sheet feed cassette 21, and one of the sheets S is separated from the others at the separation unit 31, fed to the first conveyance path 50, and conveyed to the image-forming unit 4 by using the pair of the first conveyance rollers 52. Subsequently, the first sensor 54 detects the leading end of the sheet S, and the image-forming unit 4 forms an image on the first surface of the sheet S with the timing based on detection information.

Figure 8:
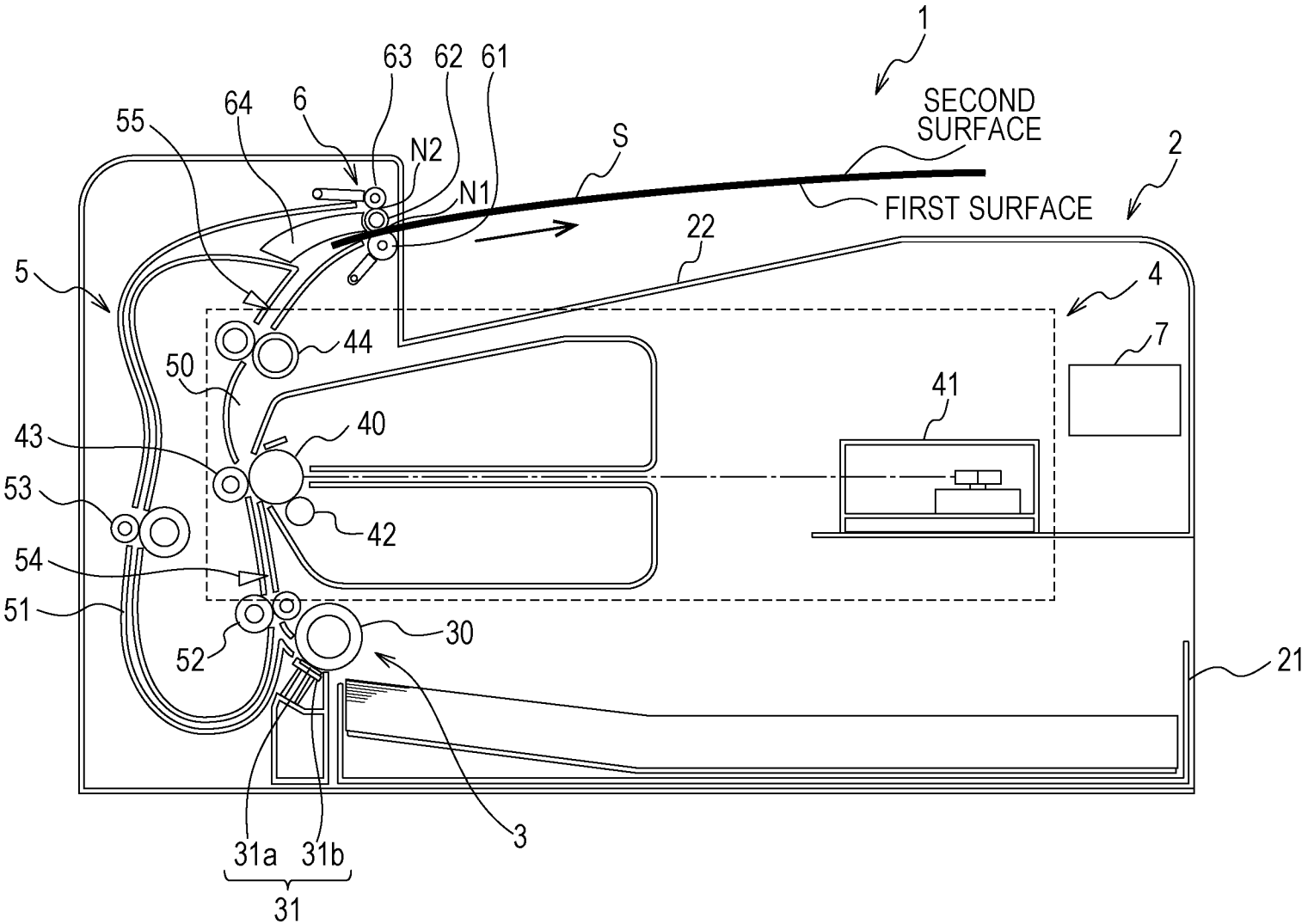
FIG. 8 illustrates operation of conveying the sheet when the images are formed on both surfaces of the sheet according to the first embodiment with a schematic sectional view.

FIG. 8 illustrates a state right before the drive roller 62 starts moving after the image is formed on the first surface of the sheet S, and the sheet S is conveyed to the reversing unit 6 with a schematic sectional view. After the toner image is transferred to the first surface of the sheet S, the toner image is fixed at the fixing portion 44, the sheet S is nipped at the first nip portions N1 that are formed by the drive roller 62 and the discharge rollers 61 and is conveyed in the first direction (direction of a solid arrow in FIG. 8). At this time, the sheet S is conveyed in the first direction in a state (first state) in which the first surface is in contact with the discharge rollers 61 and the second surface is in contact with the drive roller 62.

The second sensor 55 detects the trailing end of the sheet S in contact with the drive roller 62 and the discharge rollers 61 at the first nip portions N1. On the basis of detection information, the drive roller 62 starts moving before the trailing end of the sheet S passes through the first nip portions N1. That is, according to the present embodiment, the drive roller 62 starts moving before the trailing end of the sheet S completely passes through the first nip portions N1. As a result of movement of the drive roller 62, the sheet S that is conveyed in the first direction while being nipped at the first nip portions N1 is nipped at the second nip portions N2. The control unit 7 controls the solenoid 69*a* to start movement of the drive roller 62 on the basis of the detection information from the second sensor 55. The control unit 7 may control the solenoid 69*a* to start movement of the drive roller 62 on the basis of detection information about the leading end of the sheet S from the second sensor 55. FIGS. 11A to 11D are referred later to give a detailed description of operation of moving the drive roller 62 when the state in which the sheet S is nipped at file first nip portions N1 is switched to the state in which the sheet S is nipped at the second nip portions N2.

Figure 9:
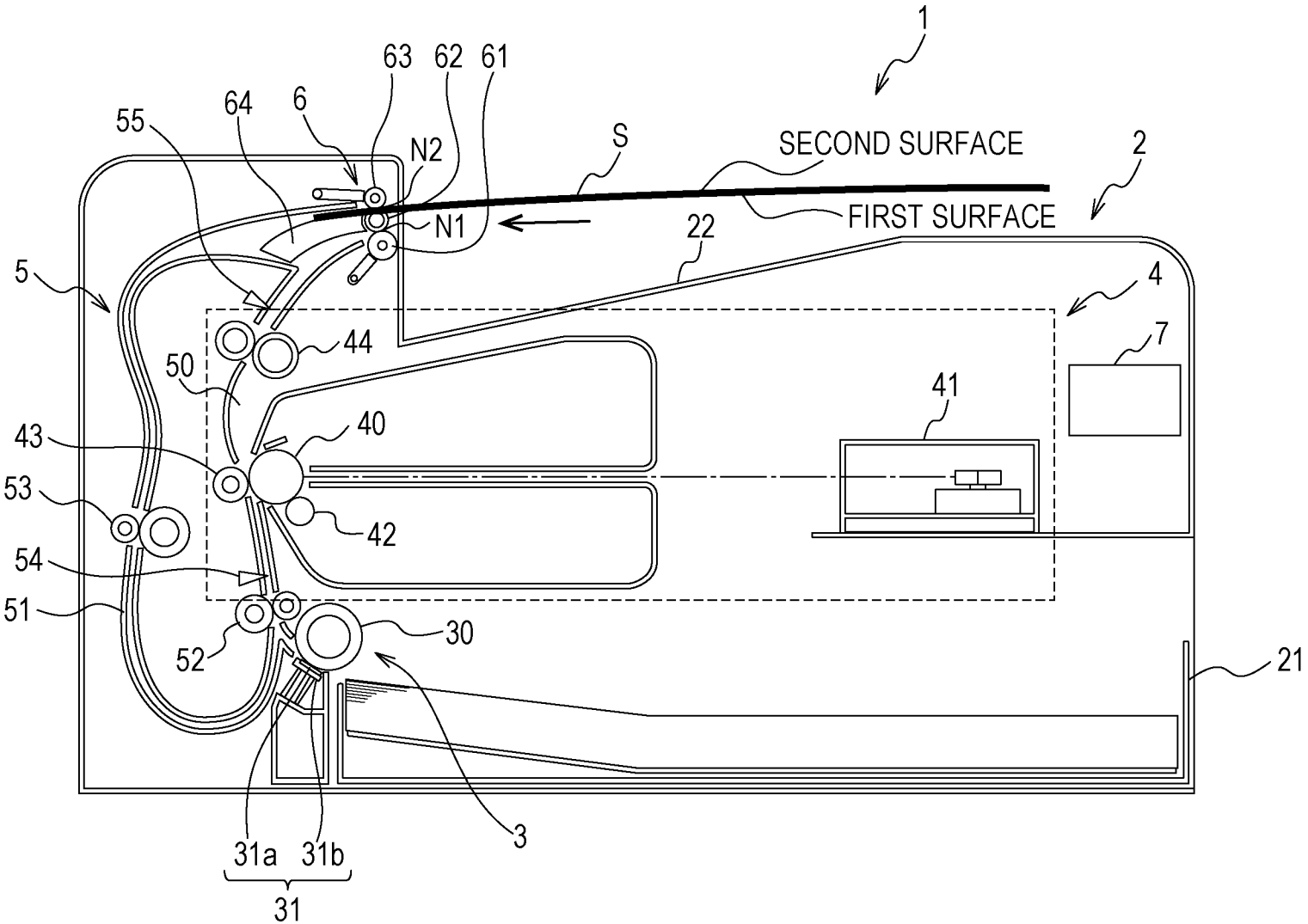
FIG. 9 illustrates operation of conveying the sheet when the images are formed on both surfaces of the sheet according to the first embodiment with a schematic sectional view.

FIG. 9 illustrates a state in which the sheet S is nipped at the second nip portions N2 after the drive roller 62 moves with a schematic sectional view. As a result of movement of the drive roller 62, the sheet S is nipped at the second nip portions N2 from the first nip portions N1, and the sheet S is conveyed in the second direction (direction of a solid arrow in FIG. 9) that differs from the first direction at the second nip portions N2. At this time, the sheet S is conveyed in the second direction in a state (second state) in which the second surface of the sheet S is in contact with the reverse rollers 63, and the first surface is in contact with the drive roller 62. Thus, the sheet S that is conveyed in the first direction at the first nip portions N1 is conveyed in the second direction at the second nip portions N2 and conveyed to the second conveyance path 51.

Figure 10:
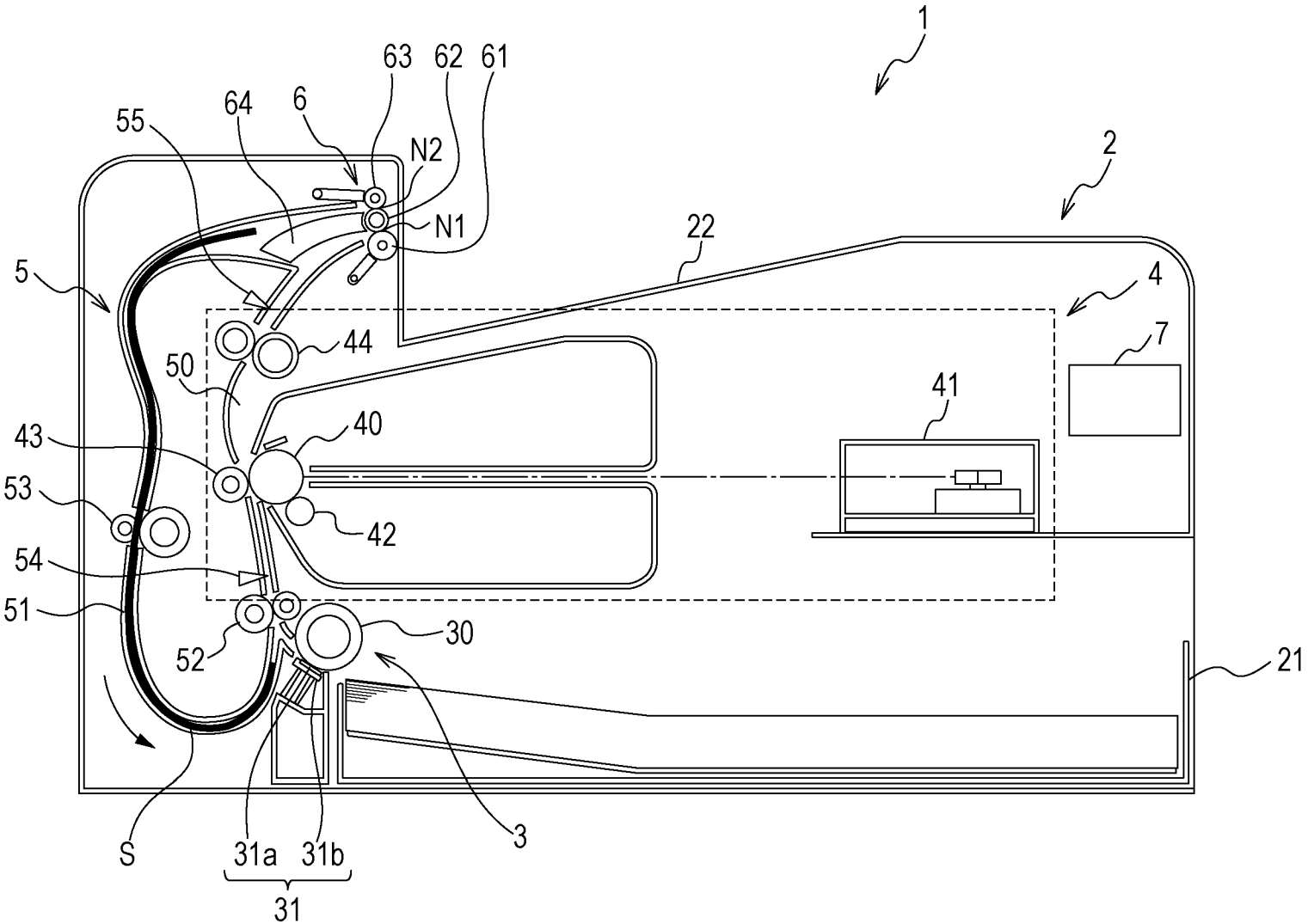
FIG. 10 illustrates operation of conveying the sheet when the images are formed on both surfaces of the sheet according to the first embodiment with a schematic sectional view.

FIG. 10 illustrates a state right before the sheet S that is conveyed in the second direction is conveyed to the image-forming unit 4 again with a schematic sectional view. As illustrated in FIG. 10, the pair of the second conveyance rollers 53 conveys the sheet S that is conveyed to the second conveyance path 51 to the first conveyance path 50. Subsequently, the transfer roller 43 of the image-forming unit 4 transfers a toner image on the second surface of the sheet S. The fixing portion 44 fixes the toner image that is formed on the second surface of the sheet S, and the images are formed on the first surface and second surface of the sheet S. After the images are formed on both surfaces of the sheet S, the sheet S is conveyed to the first nip portions N1 of the reversing unit 6 again and conveyed in the first direction at the first nip portions N1. Subsequently, the sheet S is discharged from the first nip portions N1 into the sheet discharge tray 22. At this time, the drive roller 62 does not move. In this way, the images are formed on both surfaces of the sheet S according to the present embodiment.

According to the present embodiment, the switching unit that includes the drive roller holders 65, the cams 67, the cam shaft 68, and the cam-driving member 69 causes the drive roller 62 to move to switch between the states in which the sheet S is nipped from the first state to the second state as describe above.

The following description with reference to FIGS. 11A to 11D includes operation of moving the drive roller 62 when the switching unit switches from the state in which the sheet S is nipped at the first nip portions N1 to the state in which the sheet S is nipped at the second nip portions N2.

Figure 11A:
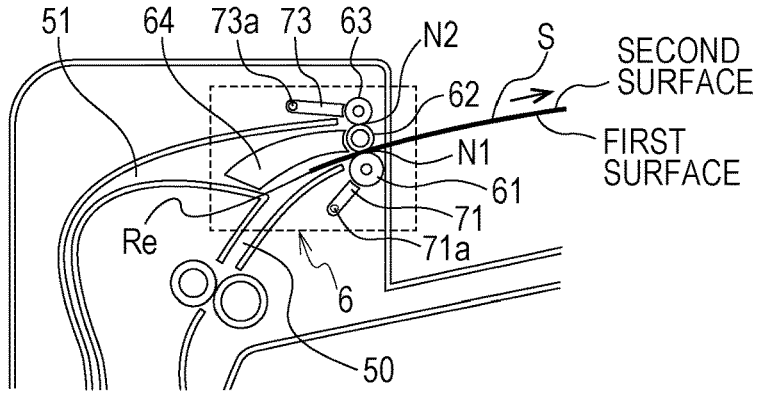
FIGS. 11A to 11D schematically illustrate movement of the drive roller according to the first embodiment.

FIG. 11A schematically illustrates a state right before the drive roller 62 starts moving after the image is formed on the first surface of the sheet S, and the sheet S is conveyed to the first nip portions N1. At this time, the drive roller 62 rotates in one direction at the initial position (first position). As illustrated in FIG. 11A, the sheet S is in contact with the drive roller 62 and the discharge rollers 61, and the drive roller 62 starts moving the direction in which the drive roller 62 is separated from the discharge rollers 61 and the reverse rollers 63 before the trailing end Re of the sheet S passes through the first nip portions N1. According to the present embodiment, as illustrated in FIG. 11A, the trailing end Re of the sheet S means the rearmost portion of the sheet S in the first direction in which the sheet S is conveyed.

Figure 11B:
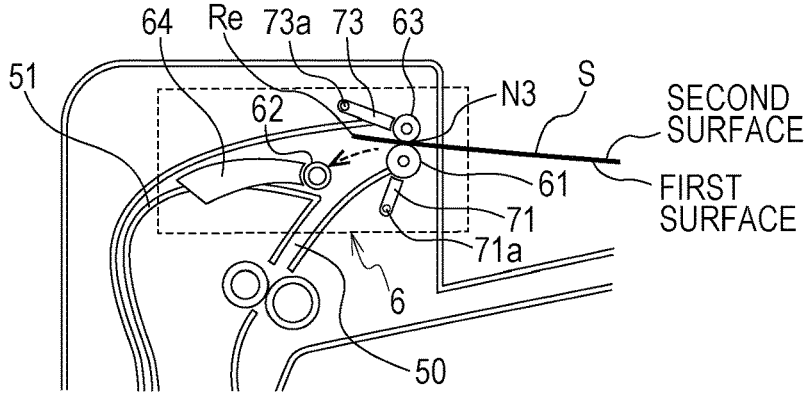

FIG. 11B schematically illustrates a state of the sheet S when the drive roller 62 moves the maximum distance and reaches the retracted position (second position). The sheet S is in contact with the drive roller 62 and the discharge rollers 61 at the first nip portions N1, and the drive roller 62 moves toward the upstream side of the trailing end Re of the sheet S in the direction in which the sheet S is conveyed at the first nip portions N1.

As illustrated in FIG. 11B, when the drive roller 62 moves from the initial position to the retracted position, the first nip portions N1 that are formed by the drive roller 62 and the discharge rollers 61 disappear, and conveyance of the sheet S is suspended. At this time, the discharge rollers 61 and the reverse rollers 63 form the third nip portions N3, the sheet S that has been conveyed in the first direction at the first nip portions N1 is nipped at the third nip portions N3 and held with conveyance of the sheet S suspended. Since the sheet S is nipped at the third nip portions N3, the sheet S can be inhibited from falling from the reversing unit 6 when the drive roller 62 moves.

After the drive roller 62 starts moving to the retracted position, the trailing end Re of the sheet S that is nipped at the third nip portions N3 moves to a position higher than that of the discharge rollers 61 due to, for example, the weight or stiffness of the sheet S, or the position or angle at which the sheet S is nipped at the third nip portions N3. Accordingly, the trailing end Re of the sheet S that is held by the third nip portions N3 is nearer than the position at which the sheet S is in contact with the discharge rollers 61 and the reverse rollers 63 to the upper side of the reverse rollers 63. At this time, the drive roller 62 that reaches the retracted position is located at a position lower than that of the trailing end Re of the sheet S that is held by the third nip portions N3.

Figure 11C:
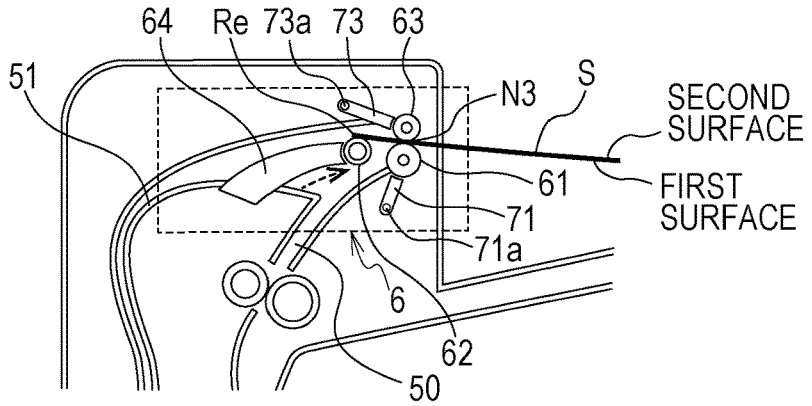

FIG. 11C schematically illustrates a state of the sheet S while the drive roller 62 is moving from the retracted position to the initial position. As illustrated in FIG. 11B, the trailing end Re of the sheet that is nipped at the third nip portions N3 moves to a position higher than that of the discharge rollers 61 due to, for example, the weight or stiffness of the sheet S, or the position or angle at which the sheet S is nipped at the third nip portions N3. In this state, as illustrated in FIG. 11C, the drive roller 62 approaches the discharge rollers 61 and the reverse rollers 63 from the lower surface side of the sheet S that is nipped at the third nip portions N3, that is, the first surface side of the sheet S. At this time, the drive roller 62 moves from the retracted position to the initial position such that the drive roller 62 increases spaces between the discharge rollers 61 and the reverse rollers 63. Consequently, the third nip portions N3 disappear, and the first nip portions N1 and the second nip portions N2 are formed again.

Figure 11D:
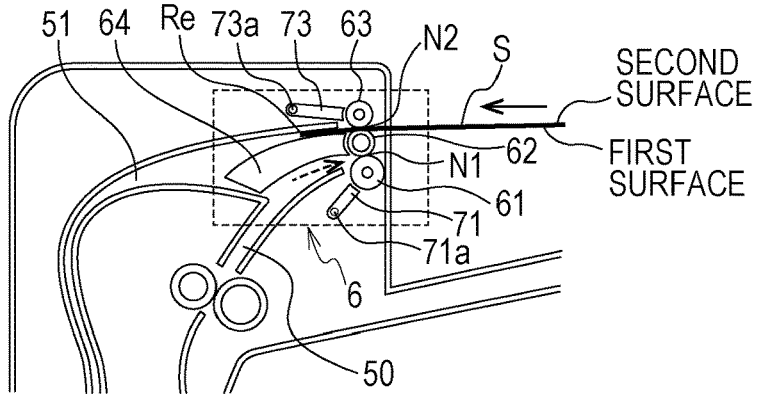

FIG. 11D schematically illustrates a state of the sheet S when the drive roller 62 reaches the initial position. As illustrated in FIG. 11D, the drive roller 62 moves from the first surface side of the sheet S to the initial position. When the drive roller 62 stops moving, the sheet S that is held by the discharge rollers 61 and the reverse rollers 63 is nipped between the drive roller 62 and the reverse rollers 63. That is, as a result of movement of the drive roller 62, the sheet S that is conveyed in the first direction at the first nip portions N1 is nipped at the second nip portions N2, and as a result of rotation of the drive roller 62, the sheet S is conveyed in the second direction at the second nip portions N2.

The control unit 7 determines the timing with which the reversing unit 6 moves the drive roller 62 in advance. When the second sensor 55 detects the trailing end Re of the sheet S, the control unit 7 causes the solenoid 69*a* to be energized with a predetermined timing, and the movable portion a1 and the partially toothless gear 69*b* disengage each other. Consequently, the partially toothless gear 69*b* is unlocked, the cams 67 rotate, the drive roller 62 moves from the initial position to the retracted position and subsequently moves from the retracted position to the initial position. The control unit 7 causes energizing the solenoid 69*a* to be stopped before the cams 67 make one rotation and the drive roller 62 reaches the initial position from the retracted position. Accordingly, when the drive roller 62 reaches the initial position from the retracted position, the movable portion a1 of the solenoid 69*a* and the partially toothless gear 69*b* engage each other again, the partially toothless gear 69*b* is locked, and the drive roller 62 stops moving at the initial position.

According to the present embodiment, the switching unit thus moves the drive roller 62 before the trailing end Re of the sheet S that is conveyed in the first direction at the first nip portions N1 passes through the first nip portions. This enables the nip portions at which the sheet S is nipped to be switched from the first nip portions N1 to the second nip portions N2 to change the direction in which the sheet S is conveyed, and the sheet S can be reversed.

According to the present embodiment, as a result of movement of the drive roller 62 from the initial position to the retracted position, the sheet S to be conveyed is held by the third nip portions N3. That is, the sheet S is not completely discharged from the reversing unit 6, and movement of the drive roller 62 enables the nip portions at which the sheet S is nipped to be switched from the first nip portions N1 to the second nip portions N2. This enables the direction in which the sheet S is conveyed to be changed without discharging the sheet S from the reversing unit 6.

As described in the background art, it can be thought that a sheet is completely discharged from first nip portions of a reverse roller group that includes a chain of three rollers, and subsequently, the sheet is conveyed to second nip portions to change the direction in which the sheet is conveyed. In this way, the sheet can be reversed with a switch back portion that temporarily receives the sheet on the downstream side of the reverse roller group in the direction in which the sheet is conveyed. That is, the switch back portion temporarily receives the sheet that is completely discharged from the first nip portions, and subsequently, the sheet is conveyed from the switch back portion to the second nip portions to change the direction in which the sheet is conveyed. However, this needs a sheet-discharging unit that discharges the sheet from the inside of the image-forming apparatus and that is disposed at a position that differs from that of a reversing portion that reverses the sheet, leading to an increased size of an apparatus.

According to the present embodiment, however, the sheet S is not completely discharged from the first nip portions N1 of the reversing unit 6, and the drive roller 62 is moved to switch the nip portions at which the sheet S is nipped from the first nip portions N1 to the second nip portions N2. For this reason, according to the present embodiment, there is no need for the switch back portion that temporarily receives the sheet S. That is, according to the present embodiment, the reversing unit 6 can reverse the sheet S and discharge the sheet S from the main body 2 into the sheet discharge tray 22. This enables the direction in which the sheet S is conveyed to be changed without increasing the size of the apparatus.

According to the present embodiment, the drive roller 62 always rotates in only one direction when the sheet S is conveyed. Accordingly, there is no need for the reversing unit 6 according to the present embodiment to change the direction of rotation of the drive roller 62 into the opposite direction when the sheet S is conveyed in the second direction, and there is no need for a mechanism to change the direction of rotation of the drive roller 62.

In FIG. 11B, the retracted position to which the drive roller 62 moves the maximum distance is located on the upstream side of the position of the trailing end Re of the sheet S that is nipped between the drive roller 62 and the discharge rollers 61 in the first direction in FIG. 11A. Movement of the drive roller 62 to a position upstream of the position of the trailing end Re of the sheet S enables the trailing end Re of the sheet S to move a position higher than that of the discharge rollers 61 due to, for example, the weight or stiffness of the sheet S, or the position or angle at which the sheet S is nipped at the third nip portions N3. At this time, the drive roller 62 that reaches the retracted position is located at a position lower than that of the trailing end Re of the sheet S that is held by the third nip portions N3. Consequently, the drive roller 62 moves toward the surface of the sheet S that is in contact with the discharge rollers 61 when the sheet S is nipped at the third nip portions N3 and moves to the initial position. The sheet S comes into contact with the drive roller 62 and is nipped between the drive roller 62 and the reverse rollers 63 at the second nip portions P2.

Operation of conveying the sheet S when images are continuously formed on both surfaces of two or more sheets will now be described with reference to FIG. 12 to FIG. 19. A sheet that is fed from the sheet feed cassette 21 at the first time is referred to as a first sheet S1, and a sheet that is subsequent to the first sheet S1 and that is fed at the second time is referred to as a second sheet S2. Similarly, a sheet that is fed at the third time is referred to as a third sheet S3, and a sheet that is fed at the fourth time is referred to as a fourth sheet S4.

Figure 12:
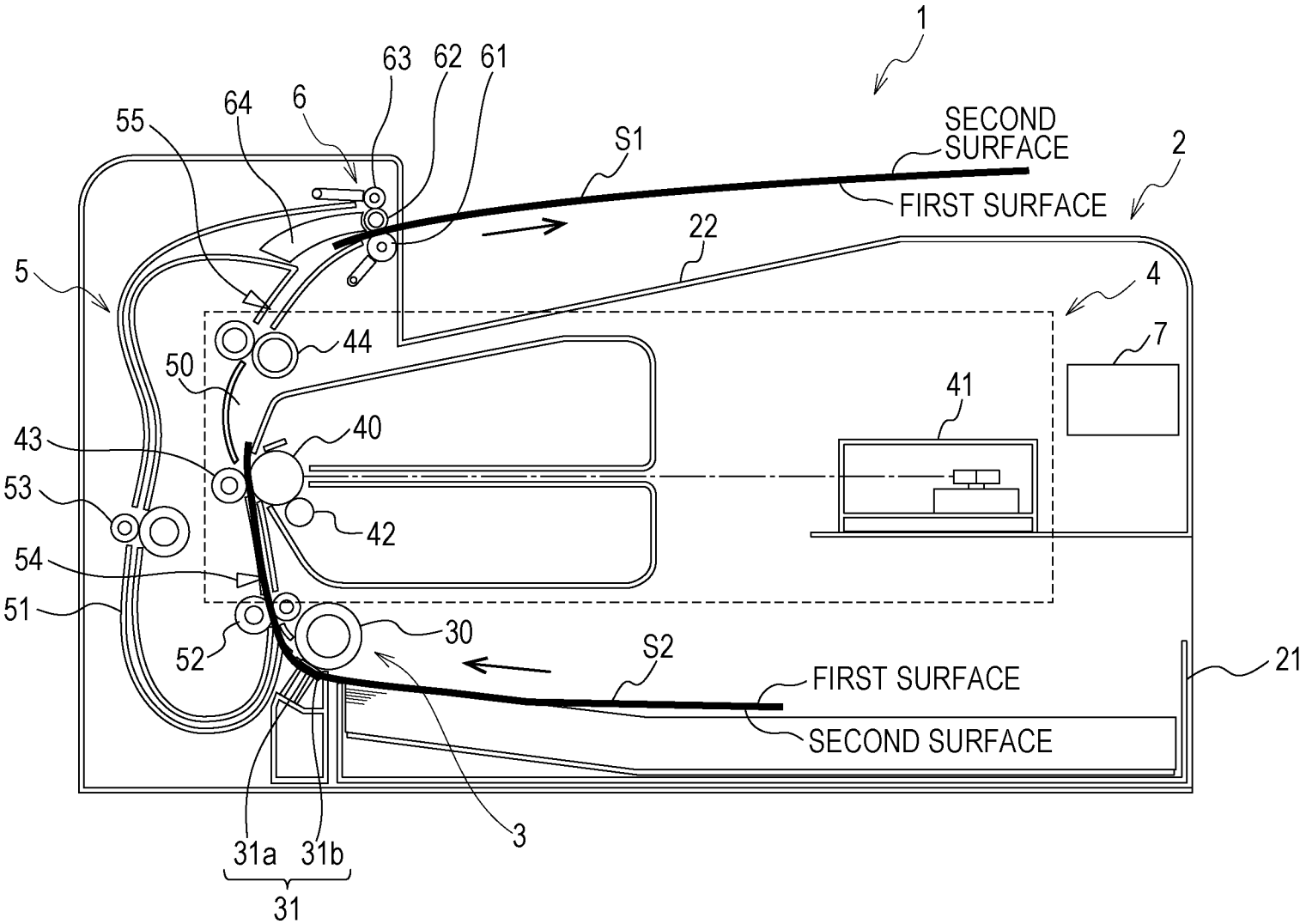
FIG. 12 illustrates operation of conveying sheets when images are continuously formed on both surfaces of the sheets according to the first embodiment with a schematic sectional view.

FIG. 12 illustrates a state right before the first sheet S1 moves from the first nip portions N1 to the second nip portions N2 as a result of movement of the drive roller 62 after the image is formed on the first surface of the first sheet S1 that is fed from the sheet feed cassette 21 by the feed roller 30 with a schematic sectional view. In the case where the images are continuously formed on two or more sheets, the second sheet S2 is fed after a predetermined interval from the trailing end of the first sheet S1 is ensured. According to the present embodiment, when the first sheet S1 moves from the first nip portions N1 to the second nip portions N2 as a result of movement of the drive roller 62, the second sheet S2 has been already fed to the feed roller 30, and the image-forming unit 4 has started transferring a toner image to the first surface.

Figure 13:
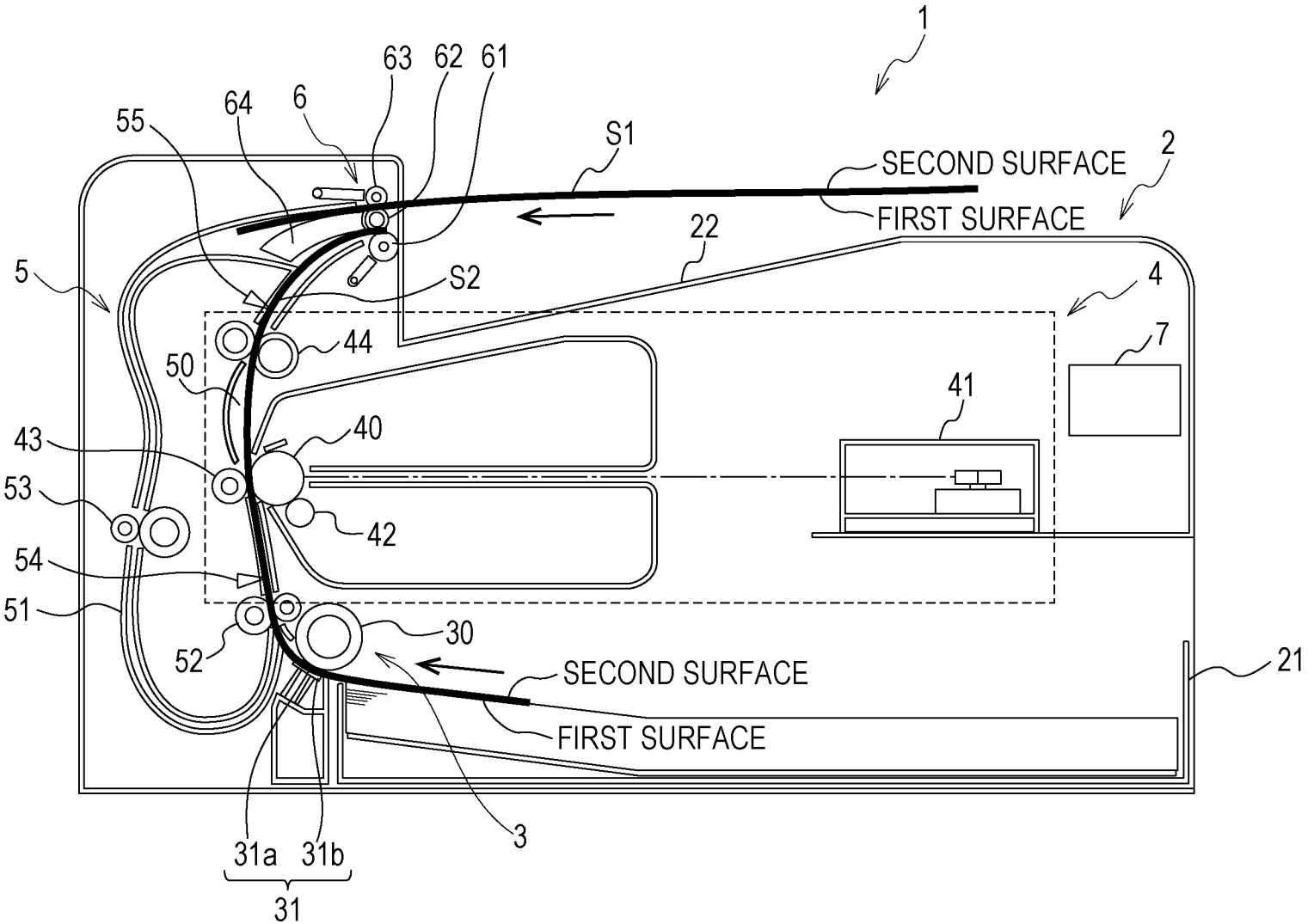
FIG. 13 illustrates operation of conveying the sheets when the images are continuously formed on both surfaces of the sheets according to the first embodiment with a schematic sectional view.

FIG. 13 illustrates a state in which the first sheet S1 is nipped at the second nip portions N2 as a result of movement of the drive roller 62 and conveyed in the second direction at the second nip portions N2 with a schematic sectional view. When the first sheet S1 that is nipped at the first nip portions N1 is nipped at the second nip portions N2 as a result of movement of the drive roller 62, the first sheet S1 is conveyed toward the second conveyance path 51 in the second direction at the second nip portions N2. Since the first sheet S1 that is nipped at the first nip portions N1 is thus nipped at the second nip portions N2 as a result of movement of the drive roller 62, the first nip portions N1 can be free after the first sheet S1 is conveyed.

This enables the second sheet S2 subsequent to the first sheet S1 to be conveyed to the first nip portions N1 of the reversing unit 6 while the first sheet S1 is conveyed in the second direction. The second sheet S2 is conveyed in the first direction at the first nip portions N1. That is, the first sheet S1 and the second sheet S2 are conveyed while passing through each other at the reversing unit 6. At this time, the second surface of the first sheet S1 is in contact with the reverse rollers 63, and the first surface of the first sheet S1 is in contact with the drive roller 62. The second surface of the second sheet S2 is in contact with the drive roller 62, and the first surface of the second sheet S2 is in contact with the discharge rollers 61.

Figure 14:
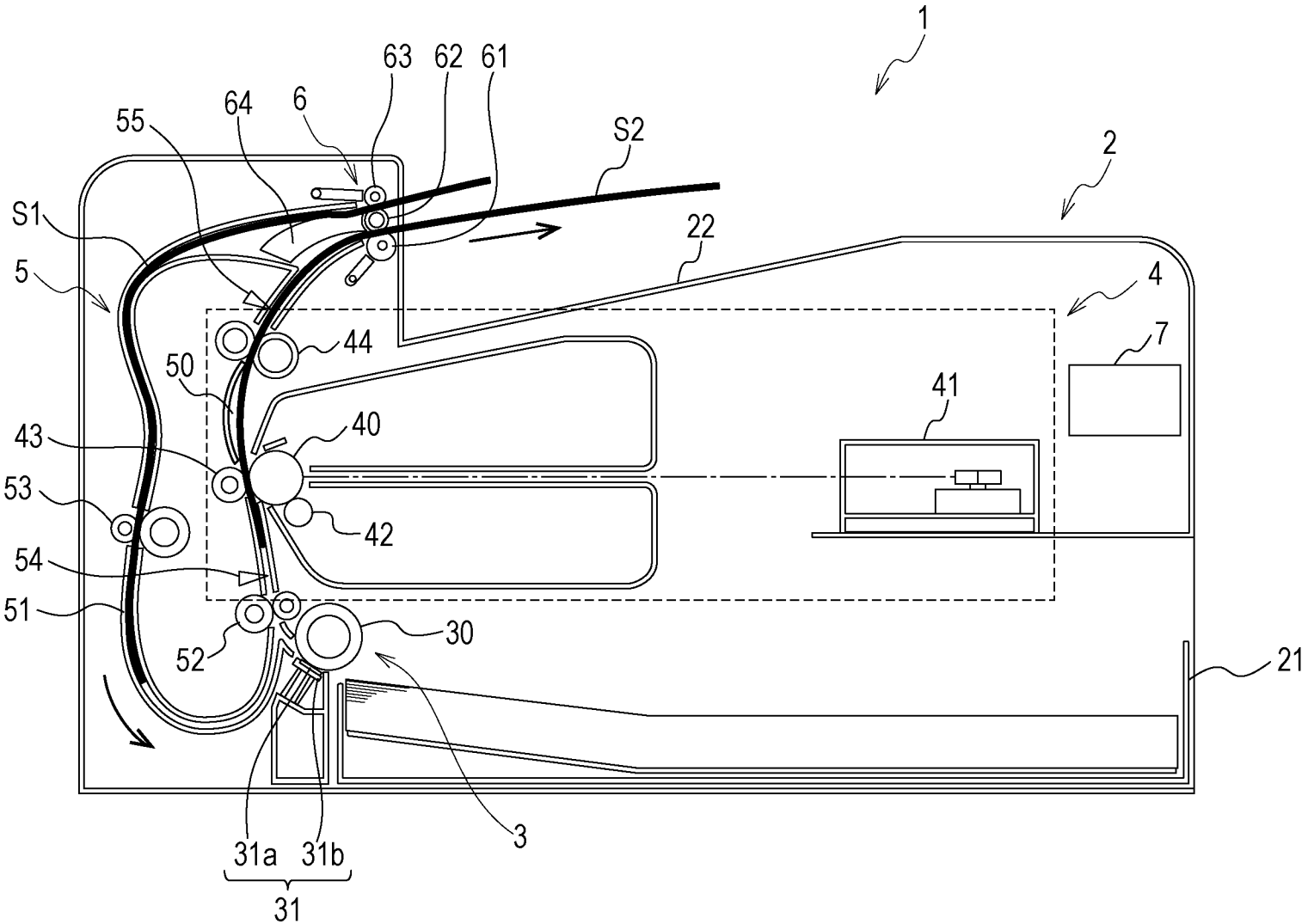
FIG. 14 illustrates operation of conveying the sheets when the images are continuously formed on both surfaces of the sheets according to the first embodiment with a schematic sectional view.

FIG. 14 illustrates a state before the first sheet S1 is conveyed from the second conveyance path 51 to the first conveyance path 50 again with a schematic sectional view. In the state in FIG. 14, the second sheet S2 is conveyed in the first direction at the first nip portions N1, and the trailing end of the second sheet S2 has already passed through the position at which the first conveyance path 50 and the second conveyance path 51 merge with each other. Accordingly, the leading end of the first sheet S1 does not collide with the trailing end of the second sheet S2, and the first sheet S1 is conveyed to the first conveyance path 50 again with the first sheet S1 being a predetermined interval spaced apart from the second sheet S2.

Figure 15:
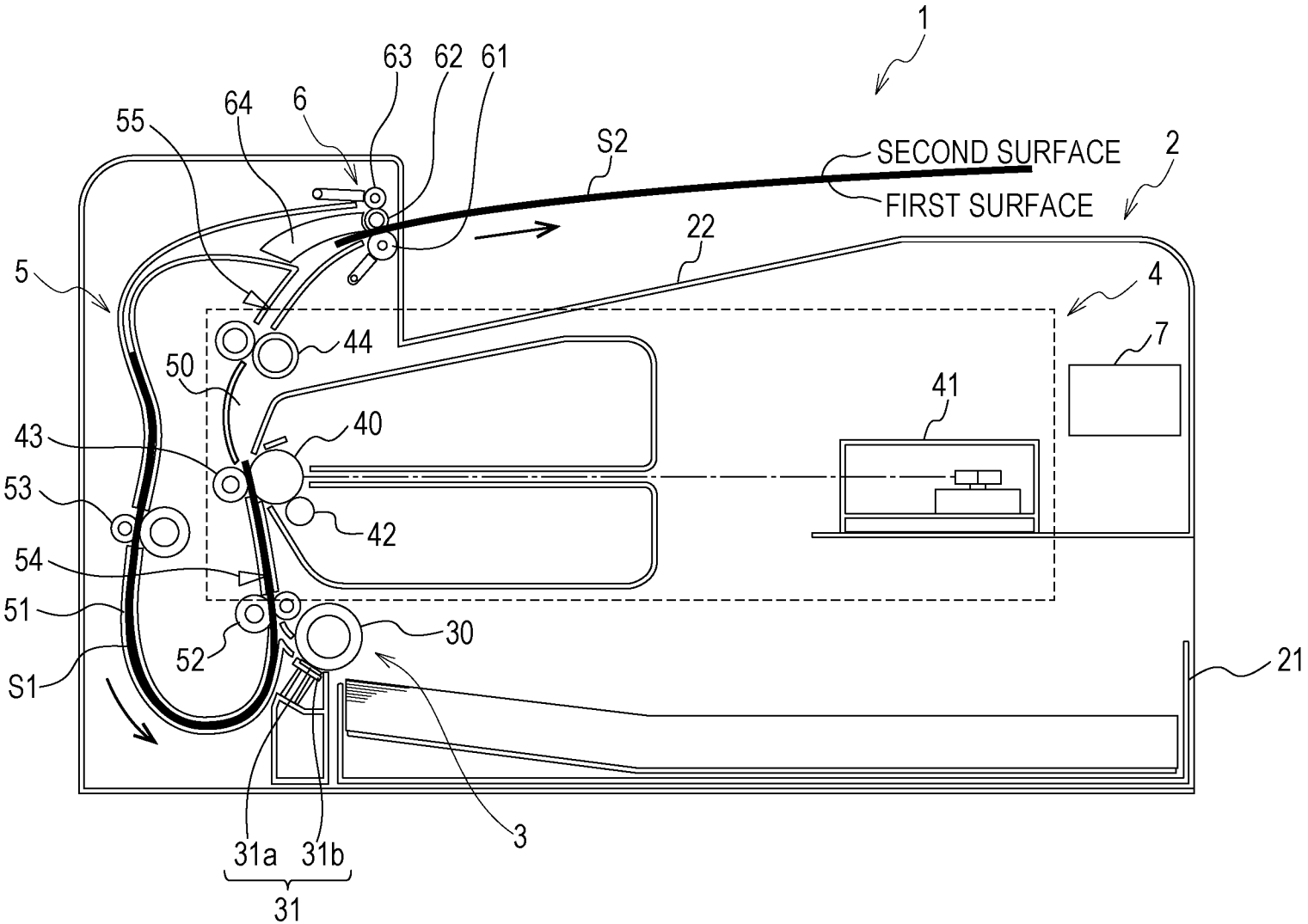
FIG. 15 illustrates operation of conveying the sheets when the images are continuously formed on both surfaces of the sheets according to the first embodiment with a schematic sectional view.

FIG. 15 illustrates a state right before the second sheet 82 moves from the first nip portions N1 to the second nip portions N2 as a result of movement of the drive roller 62 after the image is formed on the first surface of the second sheet S2. At this time, the image-forming unit 4 transfers the toner image on the second surface of the first sheet S1 that is conveyed to the first conveyance path 50 again with the first sheet S1 being a predetermined interval spaced apart from the trailing end of the second sheet S2.

Figure 16:
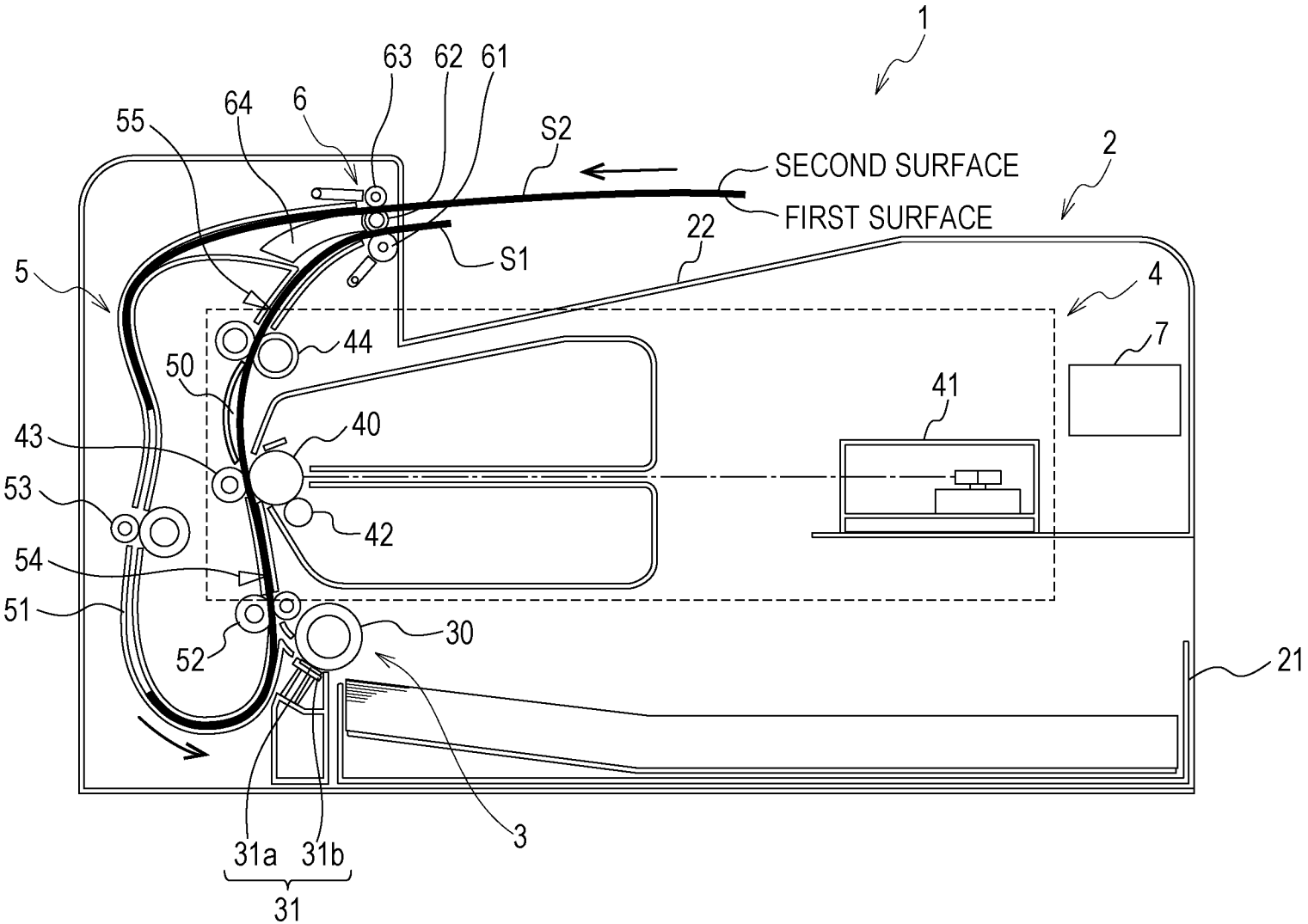
FIG. 16 illustrates operation of conveying the sheets when the images are continuously formed on both surfaces of the sheets according to the first embodiment with a schematic sectional view.

FIG. 16 illustrates a state in which the second sheet S2 is nipped at the second nip portions N2 as a result of movement of the drive roller 62 and conveyed in the second direction at the second nip portions N2 with a schematic sectional view. After the second sheet S2 is nipped at the first nip portions N1, the second sheet S2 is conveyed toward the second conveyance path 51 in the second direction at the second nip portions N2. Since the second sheet S2 is nipped at the second nip portions N2 as a result of movement of the drive roller 62 after the second sheet S2 is nipped at the first nip portions N1, the first nip portions N1 can be free as with the first sheet S1.

This enables the first sheet S1 after the image-forming unit 4 forms the image on the second surface to be conveyed in the first direction at the first nip portions N1 while the second sheet S2 is conveyed in the second direction. At this time, the second sheet S2 is conveyed in the second direction at the second nip portions N2, and the first sheet S1 after the images are formed on both surfaces is conveyed in the first direction at the first nip portions N1. That is, the first sheet S1 and the second sheet S2 are conveyed while passing through each other again at the reversing unit 6. At this time, the second surface of the second sheet S2 is in contact with the reverse rollers 63, and the first surface of the second sheet S2 is in contact with the drive roller 62. The first surface of the first sheet S1 is in contact with the drive roller 62, and the second surface of the first sheet S1 is in contact with the discharge rollers 61.

According to the present embodiment, since the second sheet S2 is thus conveyed to the reversing unit 6 when the direction in which the first sheet S1 is conveyed is changed, the first sheet S1 and the second sheet S2 are conveyed while passing through each other at the reversing unit 6. In addition, since the first sheet S1 after the images are formed on the first surface and the second surface is conveyed to the reversing unit 6 while the second sheet S2 is conveyed in the second direction at the second nip portions N2, the second sheet S2 and the first sheet S1 can be conveyed while passing through each other again.

Figure 17:
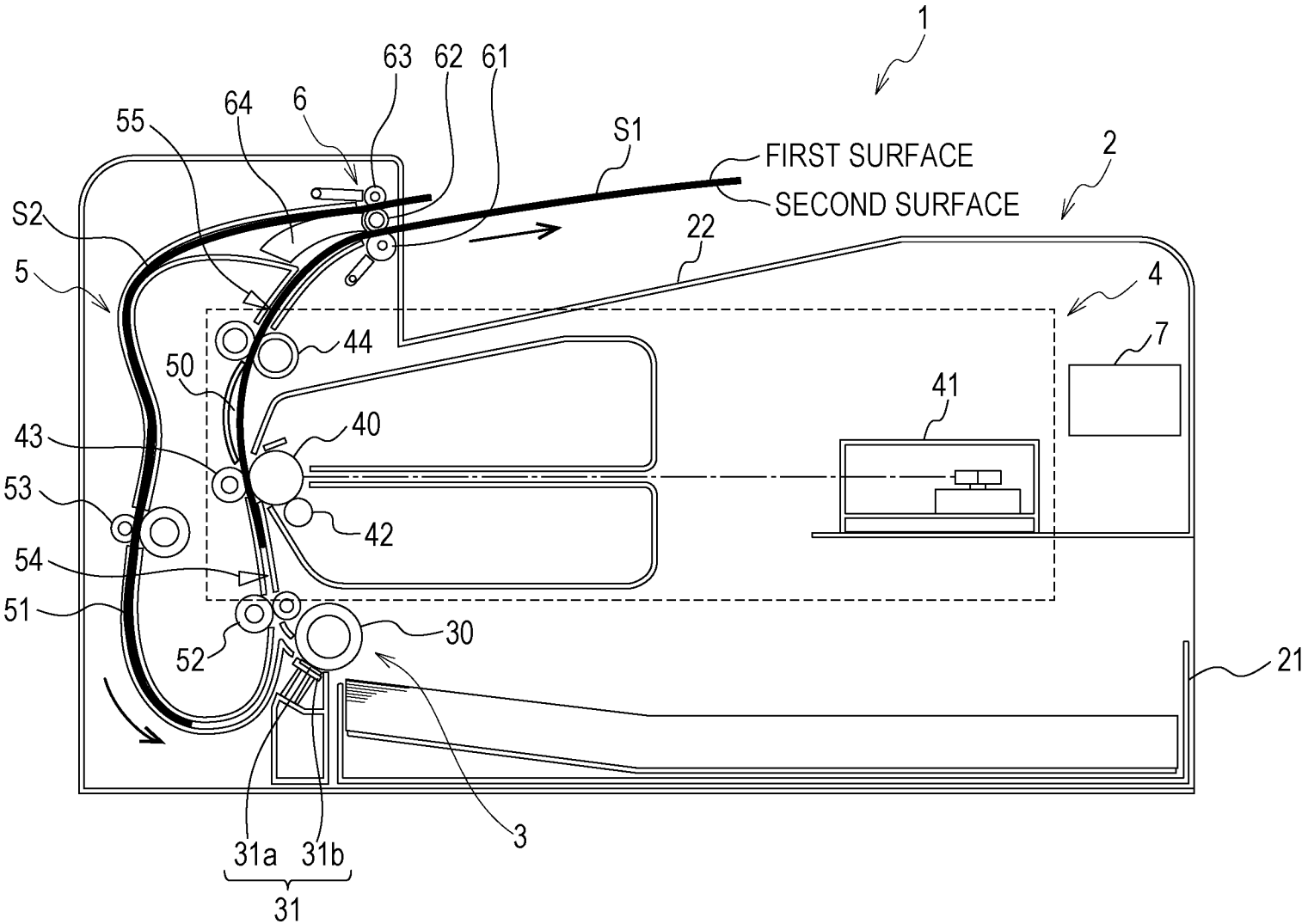
FIG. 17 illustrates operation of conveying the sheets when the images are continuously formed on both surfaces of the sheets according to the first embodiment with a schematic sectional view.

FIG. 17 illustrates a state before the second sheet S2 is conveyed from the second conveyance path 51 to the first conveyance path 50 again with a schematic sectional view. In this state, the first sheet S1 after the images are formed on both surfaces is conveyed in the first direction at the first nip portions N1, and the trailing end of the first sheet S1 has already passed through the position at which the first conveyance path 50 and the second conveyance path 51 merge with each other. Accordingly, the trailing end of the first sheet S1 does not collide with the leading end of the second sheet S2 when the second sheet S2 is conveyed to the first conveyance path 50 again. The second sheet S2 is conveyed to the first conveyance path 50 again with the second sheet S2 being a predetermined interval spaced apart from the first sheet S1.

Figure 18:
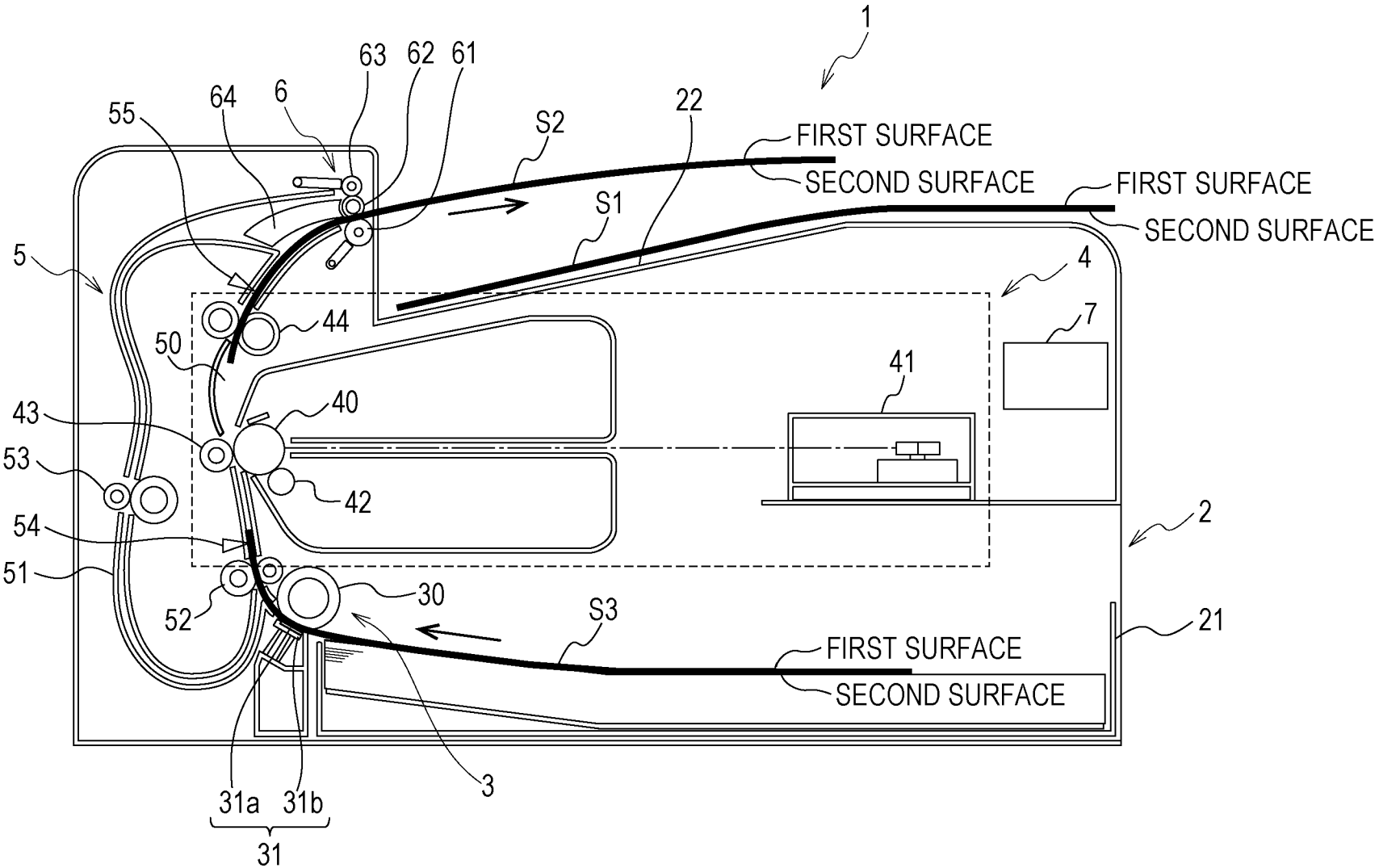
FIG. 18 illustrates operation of conveying the sheets when the images are continuously formed on both surfaces of the sheets according to the first embodiment with a schematic sectional view.

FIG. 18 illustrates a state in which the first sheet S1 after the images are formed on both surfaces has been discharged from the first nip portions N1 into the sheet discharge tray 22 with a schematic sectional view. The first sheet S1 after the images are formed on both surfaces is discharged from the first nip portions N1 into the sheet discharge tray 22 and stacked on the sheet discharge tray 22. At this time, the switching unit does not move the drive roller 62. After the second sheet S2 is conveyed to the first conveyance path 50 again, and the images are formed on the first surface and the second surface, the second sheet S2 is conveyed in the first direction at the first nip portions N1 as in the first sheet S1. At this time, the third sheet S3 is fed from the sheet feed cassette 21 toward the image-forming unit 4 with the third sheet S3 being a predetermined interval spaced apart from the trailing end of the second sheet S2.

Figure 19:
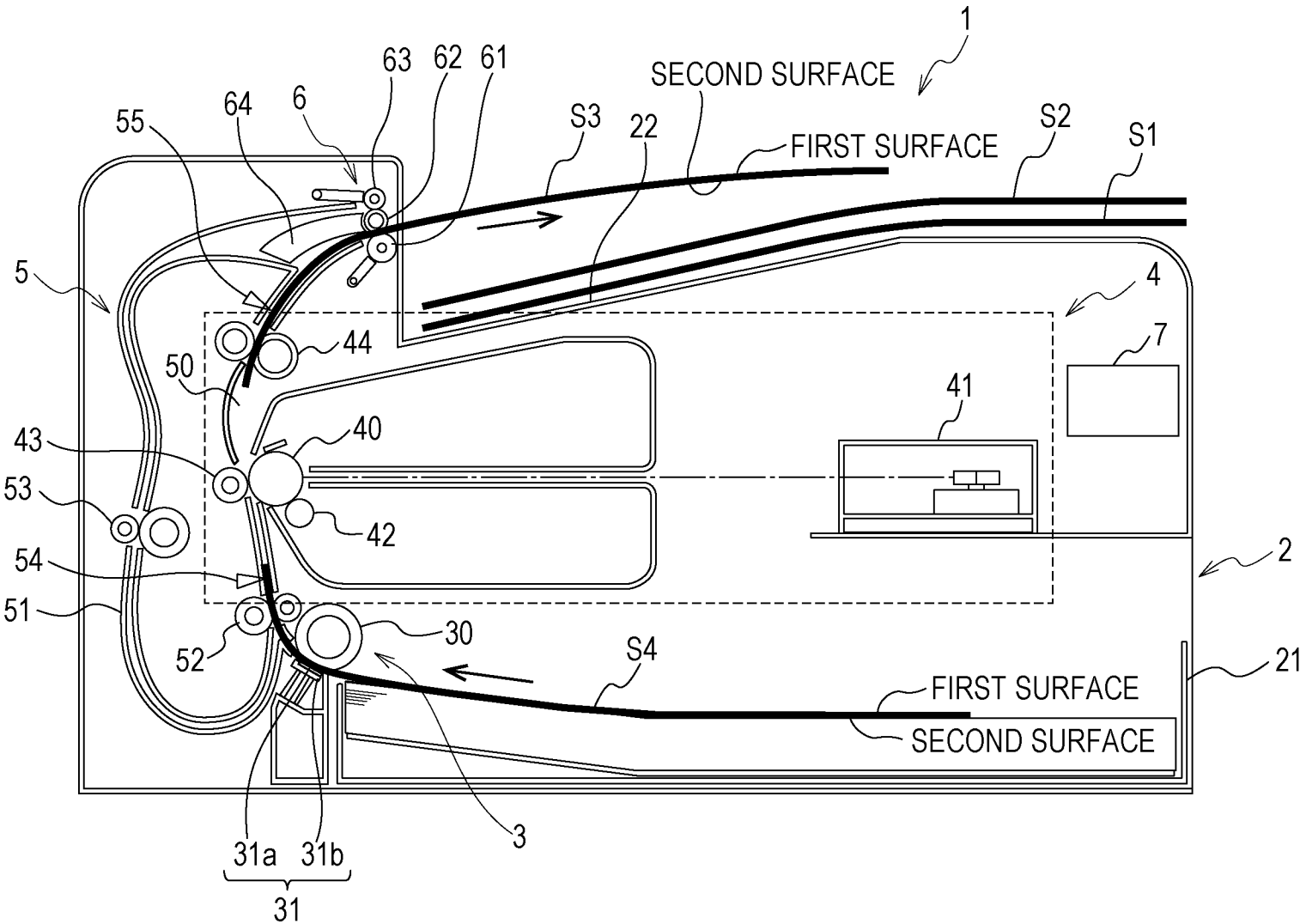
FIG. 19 illustrates operation of conveying the sheets when the images are continuously formed on both surfaces of the sheets according to the first embodiment with a schematic sectional view.

FIG. 19 illustrates a state in which the second sheet S2 after the images are formed on both surfaces has been discharged from the first nip portions N1 into the sheet discharge tray 22 with a schematic sectional view. The second sheet S2 after the images are formed on both surfaces is discharged into the sheet discharge tray 22 at the first nip portions N1 as in the first sheet S1. At this time, the switching unit does not move the drive roller 62. Consequently, the first sheet S1 and the second sheet S2 are stacked on the sheet discharge tray 22. The third sheet S3 after the image is formed on the first surface is conveyed in the first direction at the first nip portions N1 of the reversing unit 6. At this time, the fourth sheet S4 is fed from the sheet feed cassette 21 toward the image-forming unit 4 with the fourth sheet S4 being a predetermined interval spaced apart from the trailing end of the third sheet S1.

A series of operations in FIG. 12 to FIG. 19 are carried out on the third sheet S3 and the fourth sheet S4 as with the first sheet S1 and the second sheet S2. The third sheet S3 and the fourth sheet S4 after the images are formed on both surfaces are discharged into the sheet discharge tray 22 and stacked thereon.

According to the present embodiment, the operation of the reversing unit 6 to move the drive roller 62 enables the sheets S to be efficiently conveyed while the sheets S pass through each other.

According to the present embodiment, as a result of movement of the drive roller 62, the sheet S that is conveyed in the first direction at the first nip portions N1 can be conveyed to the second nip portions N2 and conveyed in the second direction as described above. That is, as a result of movement of the drive roller 62, the state in which the sheet S is nipped at the first nip portions N1 is switched to the state in which the sheet S is nipped at the second nip portions N2 after the sheet S is conveyed to the reversing unit 6. This enables the first nip portions N1 to be free and enables the second sheet S2 to be conveyed in the first direction at the first nip portions N1 while the first sheet S1 is conveyed in the second direction at the second nip portions N2 when the images are formed on both surfaces of the sheets S. As a result of movement of the drive roller 62, the second sheet S2 that is conveyed in the first direction at the first nip portions N1 can be nipped at the second nip portions N2 and conveyed in the second direction as in the first sheet S1. This enables the first nip portions N1 to be free and enables the first sheet S1 after the images are formed on both surfaces to be conveyed to the first nip portions N1 while the second sheet S2 is conveyed in the second direction. Consequently, the reversing unit 6 can efficiently convey the first sheet S1 and the second sheet S2 while the first sheet S1 and the second sheet S2 pass through each other, and the efficiency of conveyance of the sheets S can be improved.

According to the present embodiment, since the second sheet S2 can be conveyed to the reversing unit 6 while the first sheet S1 is conveyed in the second direction, the distance between the first sheet S1 and the second sheet S2 that are conveyed can be decreased. Since the distance between the first sheet S1 and the second sheet S2 that are conveyed is decreased, the second sheet S2 after the images are formed on both surfaces can be rapidly discharged.

In an example described according to the present embodiment, the drive roller 62 moves in the direction in which the drive roller 62 is separated from the discharge rollers 61 and the reverse rollers 63 when the drive roller 62 moves. The present invention, however, is not limited thereto. The drive roller 62 may move so as not to separate from the discharge rollers 61 or the reverse rollers 63. FIGS. 20A to 20E schematically illustrate movement of the drive roller 62 according to a first modification to the present embodiment. According to the first modification, the drive roller 62 moves so as not to separate from the discharge rollers 61, which will now be described with reference to FIGS. 20A to 20E.

Figure 20A:
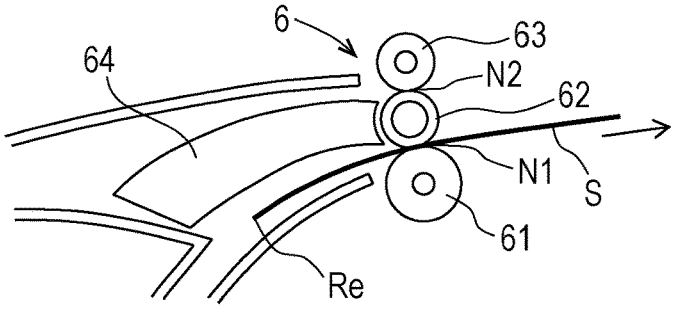
FIGS. 20A to 20E schematically illustrate movement of a drive roller according to a first modification of the first embodiment.

According to the first modification, when the sheet S that is conveyed in the first direction reaches the position in FIG. 20A, the drive roller 62 starts moving so as not to separate from the discharge rollers 61. As illustrated in FIG. 20A, before the drive roller 62 starts moving, the drive roller 62 rotates in one direction when being subjected to a driving force from the drive source at the initial position (first position). According to the first modification, movement of the drive roller 62 is controlled in the same manner as with control by the control unit 7 illustrated in the block diagram in FIG. 5 according to the first embodiment.

Figure 20B:
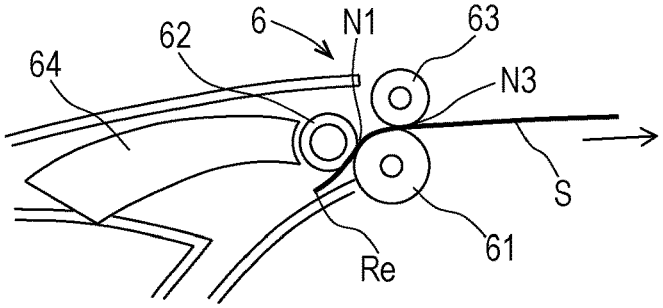

Subsequently, the drive roller 62 moves to a separation position (second position) away from the reverse rollers 63 as illustrated in FIG. 20B. As illustrated in FIG. 20B, the sheet S continues to be conveyed in the first direction with the first nip portions N1 formed. At this time, the discharge rollers 61 and the reverse rollers 63 form the third nip portions N3 as a result of movement of the drive roller 62, and the sheet S is conveyed in the first direction while being nipped at the first nip portions N1 and the third nip portions N3.

Figure 20C:
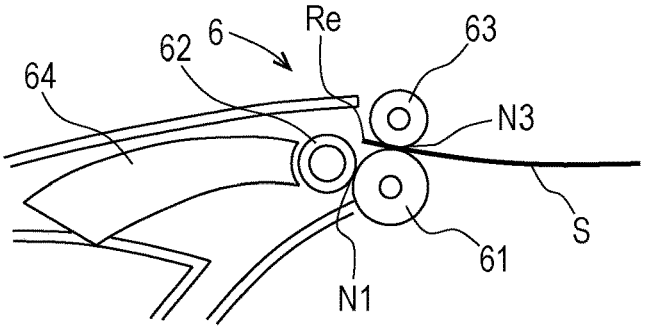
Figure 20D:
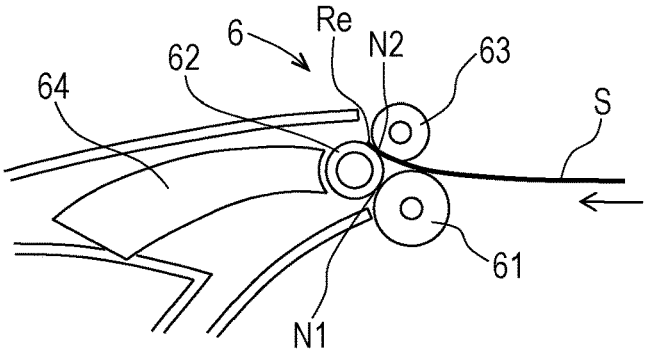

When the trailing end Re of the sheet S passes through the first nip portions N1, as illustrated in FIG. 20C, the sheet S is held by the third nip portions N3. At this time, the trailing end Re of the sheet S that is nipped at the third nip portions N3 moves to a position higher than that of the discharge rollers 61 due to, for example, the weight or stiffness of the sheet S, or the position or angle at which the sheet S is nipped at the third nip portions N3. When the drive roller 62 reaches the initial position from the retracted position in this state, as illustrated in FIG. 20D the drive roller 62 comes into contact with the reverse rollers 63, and the second nip portions N2 are formed again. The drive roller 62 returns to the initial position from the lower surface side of the sheet S that is nipped at the third nip portions N3, and the sheet S is nipped at the second nip portions N2. Subsequently, the sheet S is conveyed in the second direction at the second nip portions N2.

Figure 20E:
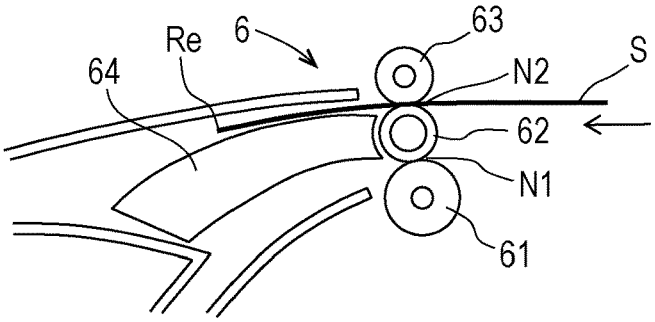

As illustrated in FIG. 20E, when the drive roller 62 reaches the initial position, the sheet S that is nipped at the first nip portions N1 before the drive roller 62 starts moving is conveyed in the second direction with the sheet S nipped at the second nip portions N2, and the direction in which the sheet S is conveyed is changed. For example, according to the first embodiment, it can be thought that the fulcrums 66 of the drive roller holders 65 are configured to be coaxial with the rotation axes of the discharge rollers 61 to move the drive roller 62 with the drive roller 62 and the discharge rollers 61 maintaining the first nip portions N1.

According to the first modification, the direction in which the sheet S is conveyed can be changed as in the first embodiment as described above. Also, in the case where the drive roller 62 is separated from the discharge rollers 61 but is not separated from the reverse rollers 63, the direction in which the sheet S is conveyed can be changed as in the first modification. Accordingly, it is only necessary for the drive roller 62 to move such that the drive roller 62 is separated from the discharge rollers 61, or the reverse rollers 63, or both in order for the reversing unit 6 to change the direction in which the sheet S is conveyed.

Figure 21:
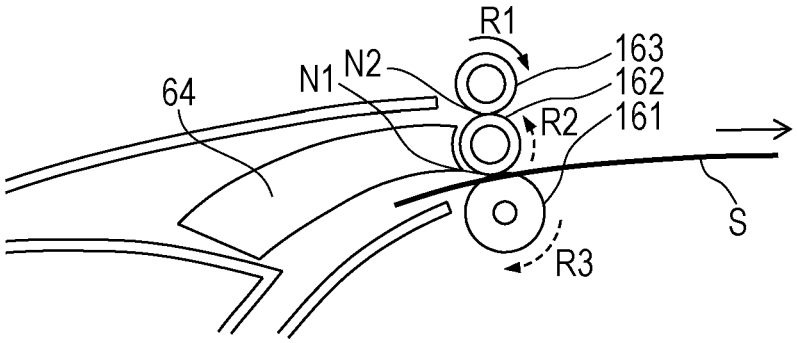
FIG. 21 schematically illustrates the structure of a reversing unit according to a second modification to the first embodiment.

In an example described according to the present embodiment, the drive roller 62 rotates when being subjected to a driving force from the drive source. The present invention, however, is not limited thereto. The discharge rollers 61 and the reverse rollers 63 may rotate when being subjected to a driving force from the drive source. FIG. 21 schematically illustrates an upper roller 163 of a reversing unit 106 according to a second modification to the present embodiment that rotates when the upper roller 163 is subjected to a driving force from the drive source. The control unit 7 in the block diagram in FIG. 5 controls movement of a central roller 162 in the same manner as in the first embodiment.

As illustrated in FIG. 21, the reversing unit 106 includes the upper roller 163 (third rotary member), the central roller 162 (first rotary member), and a lower roller 161 (second rotary member) in this order from the upper side in a direction that intersects the direction in which the sheet is conveyed. The upper roller 163 rotates in only one direction (direction of an arrow R1 in FIG. 21) when being subjected to a driving force from the drive source. The central roller 162 is a rubber roller a surface of which has a high frictional force, is in contact with the upper roller 163, and forms the second nip portions N2. Rotation of the upper roller 163 causes the central roller 162 to rotate in the direction of an arrow R2 in FIG. 21. The lower roller 161 is in contact with the central roller 162 and forms the first nip portions N1. Rotation of the central roller 162 causes the lower roller 161 to rotate in the direction of an arrow R3 in FIG. 21. This enables the sheet S to be conveyed in the first direction at the first nip portions N1 and enables the sheet S to be conveyed in the second direction at the second nip portions N2.

According to the second modification, the reversing unit 106 can thus convey the sheet S in the same manner as in the reversing unit 6 according to the first embodiment. Also, in the case where the lower roller 161 rotates when being subjected to a driving force from the drive source, the sheet S can be conveyed in the same manner as with the second modification. It is not necessary for only one roller to rotate when being subjected to a driving force from the drive source. Some of the rollers may rotate when being subjected to a driving force from the drive source.

According to the present embodiment, the discharge rollers 61, the drive roller 62, and the reverse rollers 63 convey the sheet S while nipping the sheet S therebetween. However, other members other than roller members may be used to nip the sheet S. For example, a conveyance belt may be used as the rotary member to form the first nip portions N1 and the second nip portions N2.

Second Embodiment

As illustrated in FIG. 3A to 3C and FIG. 4, the reversing unit 6 described according to the first embodiment includes the discharge rollers 61 that are in contact with the drive roller 62 and that form the first nip portions N1 and the reverse rollers 63 that are in contact with the drive roller 62 and that form the second nip portions N2. However, as illustrated in FIG. 22 and FIGS. 23A to 23C, a discharge roller 261 (second rotary member) and a reverse roller 263 (third rotary member) according to the present embodiment are not in contact with a drive roller 262 (first rotary member) and have alternate arrangement. The present embodiment is the same as the first embodiment except for the structure of a reversing unit 206. Accordingly, a description of components like to those in the first embodiment is omitted, and differences from the first embodiment are mainly described with reference to FIG. 22 and FIGS. 23A to 23C.

Figure 22:
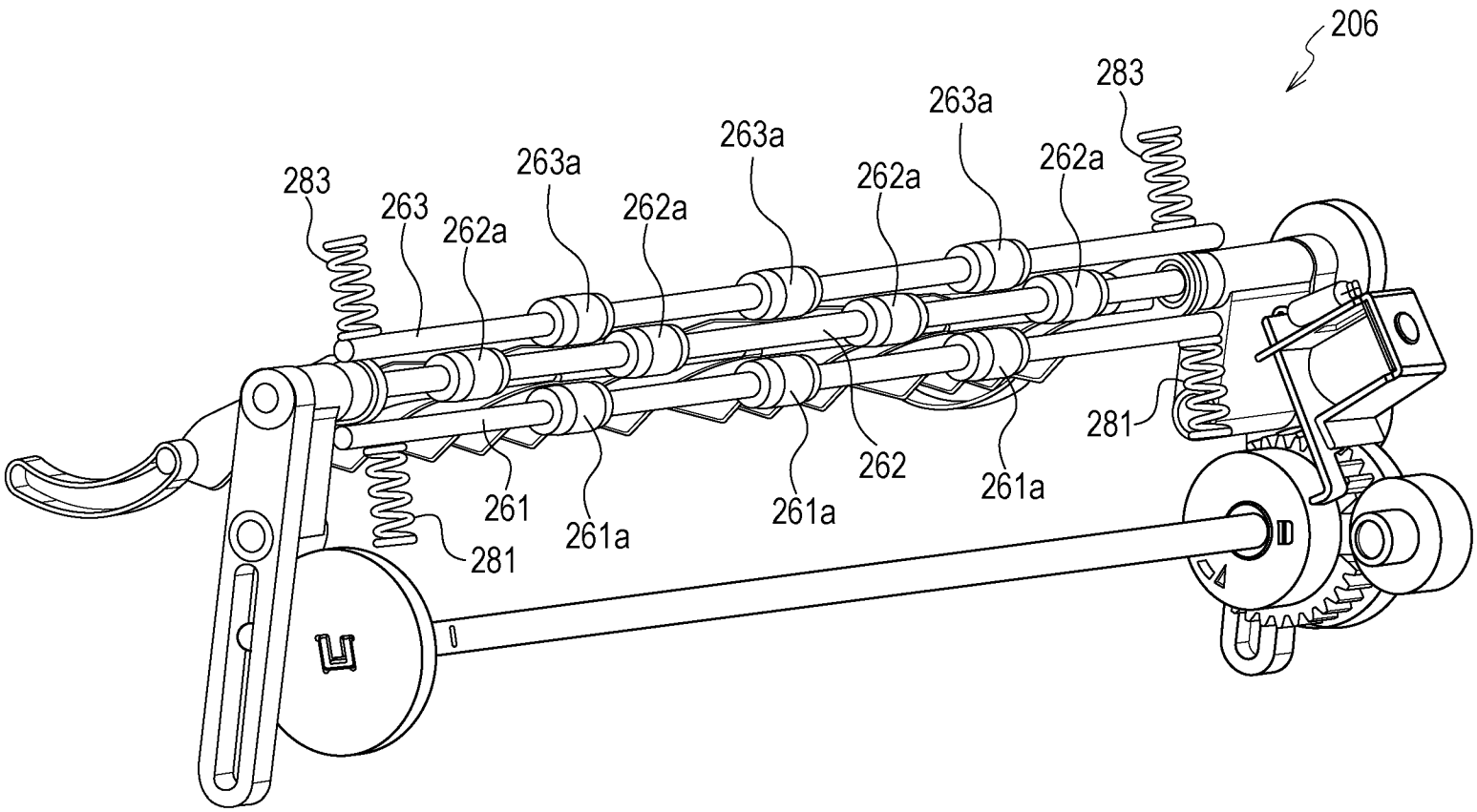
FIG. 22 schematically illustrates a reversing unit according to a second embodiment.

FIG. 22 schematically illustrates the structure of the reversing unit 206 according to the present embodiment viewed from the downstream side in the direction in which the sheet is conveyed. Each of the drive roller 262, the discharge roller 261, and the reverse roller 263 has contact portions that come into contact with the sheet S in a direction that intersects the direction in which the sheet S is conveyed. As illustrated in FIG. 22, the drive roller 262 includes roller portions 262*a* (first contact portions), the discharge roller 261 includes roller portions 261*a* (second contact portions), and the reverse roller 263 includes roller portions 263*a* (third contact portions).

According to the present embodiment, the roller portions 261*a* of the discharge roller 261 are not in contact with the roller portions 262*a* of the drive roller 262 and are formed as comb rollers that alternate therewith. The discharge roller 261 is urged toward the drive roller 262 by using springs 281 (first urging members) that are disposed on the main body 2 and conveys the sheet together with the drive roller 262.

The rollers that have a function of discharging the sheet S are formed as the comb rollers to increase the stiffness of the sheet S during conveyance such that the sheet S slightly waves in the width direction. The increase stiffness of the sheet S that is conveyed in the first direction by using the discharge roller 261 and the drive roller 262 prevents the leading end of the sheet S from falling. With this structure, the sheet S can be more effectively stacked when being discharged.

The roller portions 263*a* of the reverse roller 263 are not in contact with the roller portions 262*a* of the drive roller 262 and are formed as comb rollers that alternate therewith as in the roller portions 261*a*. The reverse roller 263 is urged toward the drive roller 262 by using springs 283 (second urging members) that are disposed on the main body 2 and conveys the sheet together with the drive roller 262. The roller portions 263*a* face the respective roller portions 261*a* in a direction that intersects the direction in which the sheet is conveyed.

Figure 23A:
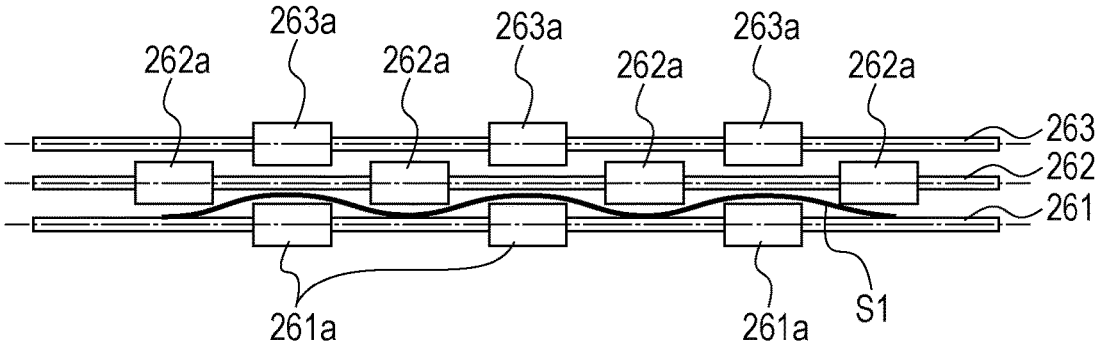
FIGS. 23A to 23C schematically illustrate the reversing unit according to the second embodiment that conveys sheets.
Figure 23B:
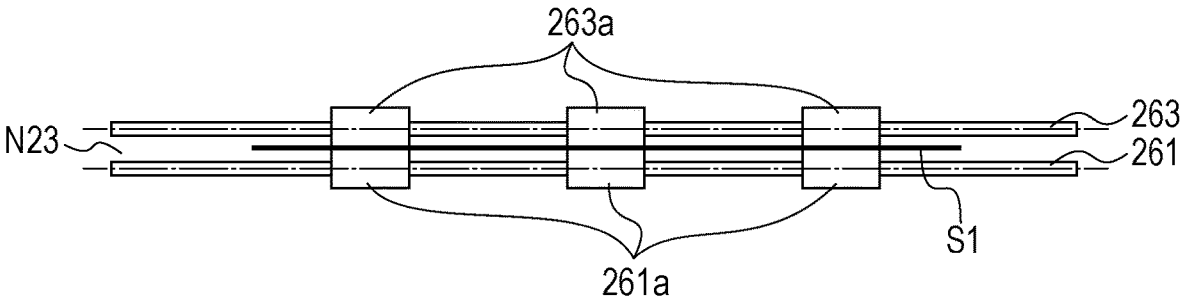
Figure 23C:
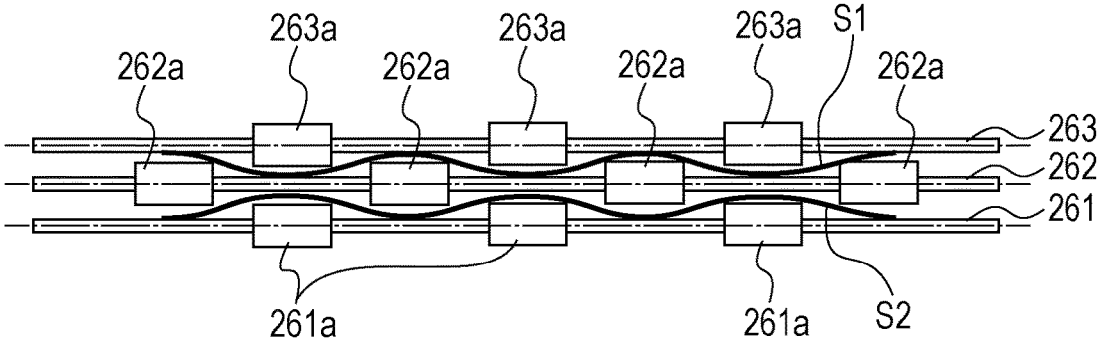

FIGS. 23A to 23C schematically illustrate a state of each sheet S when the reversing unit 206 is viewed from the direction in which the sheet is conveyed. FIG. 23A illustrates a state before the drive roller 262 starts moving. FIG. 23B illustrates a state in which the sheet S that is conveyed in the first direction by the drive roller 262 and the discharge roller 261 is held by the discharge roller 261 and the reverse roller 263 as a result of movement of the drive roller 262. FIG. 23C schematically illustrates a state when the drive roller 262 stops moving. As illustrated in FIG. 23C, the state in which the first sheet S1 is in contact with the derive roller 262 and the discharge roller 261 is switched to the state in which the first sheet S1 is in contact with the drive roller 262 and the reverse roller 263 as a result of movement of the drive roller 262. At this time, the drive roller 262 and the discharge roller 261 convey the second sheet S2 that reaches the reversing unit 206 in the first direction.

In the state in FIG. 23A, the comb rollers of the drive roller 262 and the discharge roller 261 increase the stiffness of the first sheet S1 that is conveyed in the first direction with the first sheet S1 waving. At this time, the first sheet S1 is conveyed in the first direction in the first state in which the first surface of the first sheet S1 is in contact with the discharge roller 261 and the second surface of the first sheet S1 is in contact with the drive roller 262.

In the state in FIG. 23B after the drive roller 262 starts moving, the discharge roller 261 and the reverse roller 263 hold the first sheet S1 and do not convey the first sheet S1. The roller portions 261*a* and the roller portions 263*a* face each other in the direction that intersects the direction in which the sheet is conveyed. Accordingly, in the state in FIG. 23B, the first sheet S1 is nipped and held by third nip portions N23 that serve as holding portions formed by the roller portions 261*a* and the roller portions 263*a*.

As illustrated in FIG. 23C, after the drive roller 262 stops moving, the first sheet S1 is conveyed in the second direction in the second state in which the second surface is in contact with the reverse roller 263 and the first surface is in contact with the drive roller 262. Movement of the drive roller 262 enables the second sheet S2 to be conveyed to the reversing unit 206. The second sheet S2 is conveyed in the first direction in the first state in which the second surface is in contact with the drive roller 262 and the first surface is contact with the discharge roller 261. At this time, the comb rollers of the discharge roller 261 and the reverse roller 263 that alternate with the roller portions of the drive roller 262 increase the stiffness of the first sheet S1 and the second sheet S2 with the first sheet S1 and the second sheet S2 waving, and the first sheet S1 and the second sheet S2 are conveyed while passing through each other at the reversing unit 206.

The same effects as in the first embodiment can be achieved also in the case where the discharge roller 261 and the drive roller 262 are formed as the comb rollers, and the reverse roller 263 and the drive roller 262 are formed as the comb rollers.

Third Embodiment

According to the first embodiment, the drive roller 62 of the reversing unit 6 reciprocates between the initial position and the separation position on the same path when the drive roller 62 moves. However, as illustrated in FIGS. 24A to 24D, a drive roller 362 of a reversing unit 306 according to a third embodiment moves from the initial position to the retracted position on a path that differs from a path on which the drive roller 362 moves from the retracted position to the initial position. The present embodiment is the same as the first embodiment except that the drive roller 362 moves from the initial position to the retracted position on the path that differs from the path on which the drive roller 362 moves from the retracted position to the initial position. Accordingly, a description of components like to those in the first embodiment is omitted, and differences from the first embodiment are mainly described with reference to FIGS. 24A to 24D.

Figure 24A:
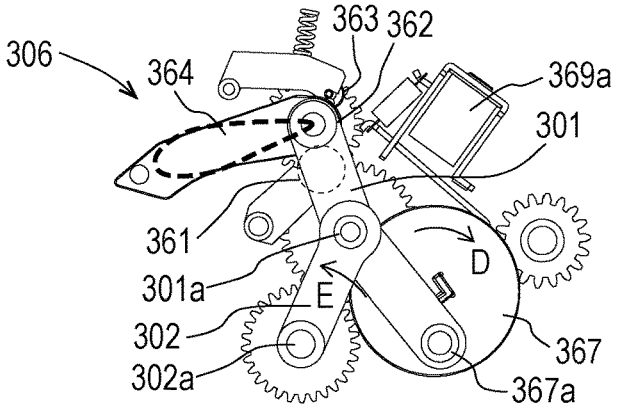
FIGS. 24A to 24D schematically illustrate the structure of a reversing unit and operation of a drive roller according to a third embodiment.

FIG. 24A schematically illustrates the reversing unit 306 viewed from the axial direction of the drive roller 362 before the drive roller 362 starts moving. At this time, the drive roller 362 rotates in one direction when being subjected to a driving force from the drive source at the initial position (first position). As illustrated in FIG. 24A, the reversing unit 306 includes drive roller holders 301 and link levers 302. End portions of the drive roller holders 301 engage respective projections 367*a* of cams 367 so as to be swingable. The other end portions of the drive roller holders 301 hold the drive roller 362. The link levers 302 include at ends thereof respective shafts 302*a* that are rotatably fitted in the main body 2. The other end portions of the link levers 302 are engage respective link shafts 301*a* that are disposed on the drive roller holders 301 at intermediate positions of the drive roller holders 301 so as to be swingable.

In the state in FIG. 24A, when a solenoid 369*a* is energized, the cams 367 rotate in the direction of an arrow D in FIG. 24A, and the drive roller holders 301 that engage the projections 367*a* move. As a result of movement of the drive roller holders 301, the link levers 302 that engage the link shafts 301*a* of the drive roller holders 301 swing about the shafts 302*a* in the direction of an arrow E in FIG. 24A. Consequently, the drive roller 362 moves in the direction in which the drive roller 362 is separated from a discharge roller 361 and a reverse roller 363.

Figure 24B:
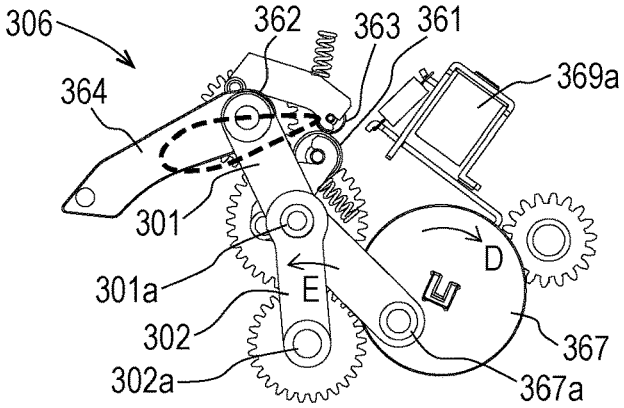
Figure 24C:
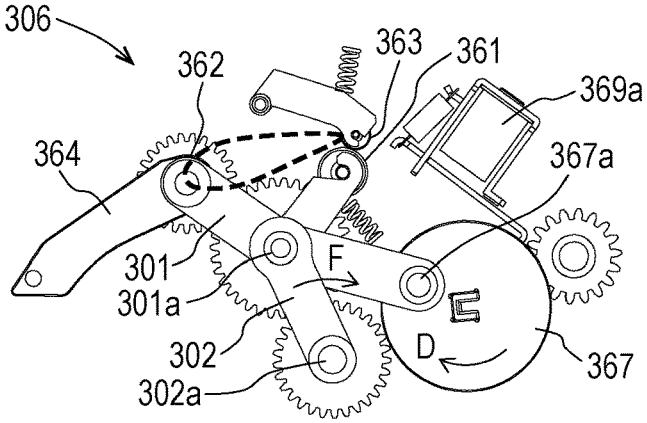

FIG. 24B schematically illustrates the drive roller 362 and reversing guides 364 that move as a result of rotation of the cams 367 viewed from the axial direction of the drive roller 362. A dotted line in FIG. 24B represents a path on which the drive roller 362 moves. FIG. 24C schematically illustrates the reversing unit 306 viewed from the axial direction of the drive roller 362 when the drive roller 362 and the reversing guides 364 move as a result of rotation of the cams 367, and the drive roller 362 moves the maximum distance. At this time, the drive roller 362 is at the retracted position (second position) that is retracted from the initial position.

Figure 24D:
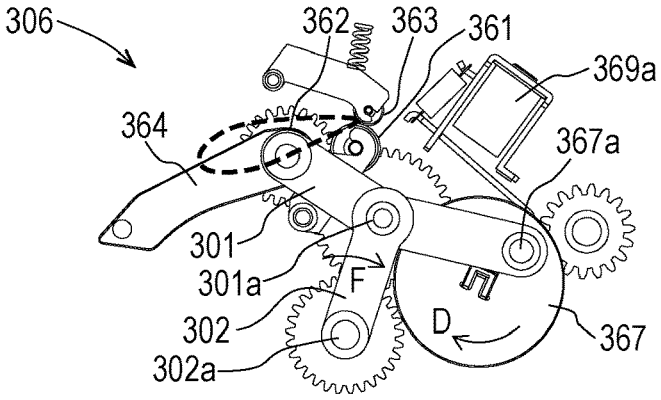

In the state in FIG. 24C, when the cams 367 further rotate in the direction of an arrow D in FIG. 24C, the link levers 302 swing in the direction of an arrow F in FIG. 24C, and consequently, the drive roller 362 moves from the retracted position to the initial position. FIG. 24D schematically illustrates the reversing unit 306 viewed from the axial direction of the drive roller 362 when the drive roller 362 returns from the retracted position to the initial position. According to the present embodiment, the posture of the drive roller holders 301 in FIG. 24D differs from that in FIG. 24B. That is, the drive roller 362 moves from the retracted position to the initial position on a path that differs from the path on which the drive roller 362 moves from the initial position to the retracted position.

The drive roller 362 of the reversing unit 306 according to the present embodiment moves from the initial position to the retracted position on the path that differs from the path on which the drive roller 362 moves from the retracted position to the initial position as describe above. The use of the reversing unit 306 according to the present embodiment enables the sheet S to be conveyed in the same manner as in the first embodiment and enables the same effects as in the first embodiment to be achieved.

According to the present embodiment, the drive roller 362 cart move more smoothly than in the case where the drive roller 362 reciprocates on the same path according to the first embodiment. The reason is that the drive roller 362 can move smoothly when the drive roller 362 returns from the retracted position in the case where the drive roller 362 moves from the initial position to the retracted position on the path that differs from the path on which the drive roller 362 moves from the retracted position to the initial position. This enables the magnitude of a sound to be decreased more than in the case of using the reversing unit 6 according to the first embodiment.

Another Embodiment

Figure 25:
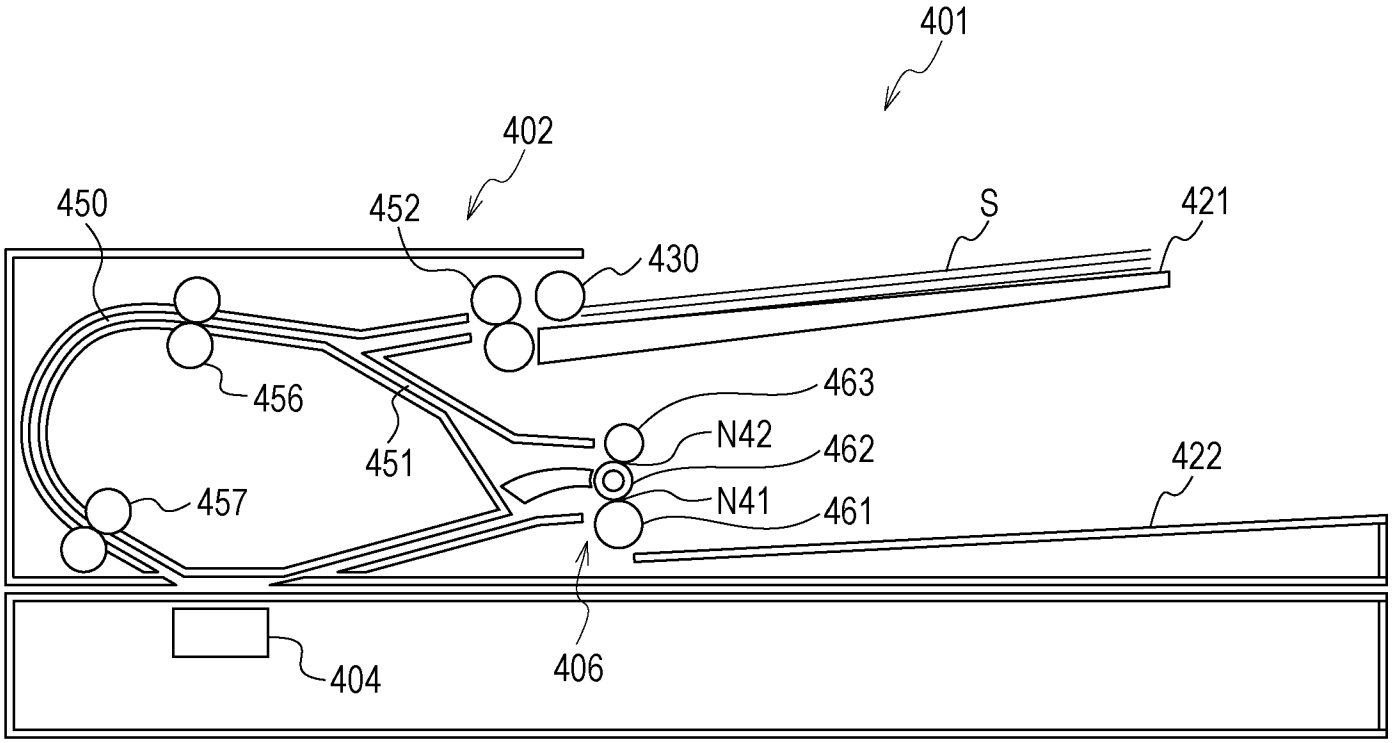
FIG. 25 is a schematic sectional view of a sheet-conveying device according another embodiment.

According to the above embodiments, the image-forming apparatus is described as the sheet-conveying device. According to the present invention, however, the sheet-conveying device is not limited thereto. The present invention can be used for an apparatus that changes the direction in which the sheet S is conveyed from a first conveyance direction into a second conveyance direction, which can achieve the same effects as the above embodiments of the present invention. That is, as illustrated in FIG. 25, the present invention cart be used also for art image-reading apparatus that reads images on the sheet S to be conveyed, which can achieve the same effects.

An image-reading apparatus 401 that corresponds to a sheet-conveying device according to the present embodiment includes an image-reading unit 404 that reads images on the sheet s to be conveyed. A reversing unit 406 according to the present embodiment is the same as the reversing unit according to the first embodiment. Accordingly, differences from the first embodiment, such as the structure of the image-reading apparatus 401 and how to read the images on both surfaces of the sheet S are mainly described, and a description of components like to those in the first embodiment is omitted.

The sheets S that are stacked on a sheet feed tray 421 that serves as the receiving unit are fed as a result of rotation of a feed roller 430 and are separated one by one by a separation unit 452. Subsequently, a pair of conveyance rollers 456 and a pair of conveyance rollers 457 convey each sheet S to the image-reading unit 404 on a first conveyance path 450. The image-reading unit 404 reads the image on the first surface of the sheet. The sheet S after the image on the first surface is read is conveyed to the reversing unit 406 and nipped at first nip portions N41 that are formed by a drive roller 462 (first rotary member) and discharge rollers 461 (second rotary members). The sheet S that is nipped between the drive roller 462 and the discharge rollers 461 is conveyed from the drive roller 462 toward a sheet discharge tray 422 that serves as the stack portion as a result of rotation of the drive roller 462 and conveyed in the direction (first direction) in which the sheet S is discharged from a main body 402 of the apparatus. The drive roller 462 starts moving before the trailing end Re of the sheet S that the drive roller 462 and the discharge rollers 461 convey reaches the sheet discharge tray 422.

The sheet S that is nipped at the first nip portions N41 is nipped at second nip portions N42 that are formed by the drive roller 462 and reverse rollers 463 as a result of movement of the drive roller 462 and conveyed in the direction (second direction) from the sheet discharge tray 422 toward a second conveyance path 451. Subsequently, the pair of the conveyance rollers 456 and the pair of the conveyance rollers 457 convey the sheet S to the image-reading unit 404 on the first conveyance path 450 again. The image-reading unit 404 reads the image on the second surface of the sheet S. The sheet S after the images on the first surface and the second surface are read is conveyed to the first nip portions N41 again, conveyed in the first direction at the first nip portions N1, and is subsequently discharged into the sheet discharge tray 422.

Also, according to the present embodiment, as a result of movement of the drive roller 462 of the reversing unit 406, the sheet S that is nipped at the first nip portions N41 can be nipped at the second nip portions N42 without being completely discharged from the reversing unit 406. The reversing unit 406 includes the switching unit that switches between the states in which the sheet S is nipped as in the reversing unit 6 according to the first embodiment. Accordingly, the reversing unit 406 can switch the nip portions at which the sheet S is nipped from the first nip portions N41 to the second nip portions N42 before the trailing end Re of the sheet S that is conveyed in the first direction passes through the first nip portions N41. The present invention can be used for the image-reading apparatus that reads the images on the sheet S to be conveyed, which can achieve the same effects as in the first embodiment as described above.

In examples describes according to the above embodiments, the present invention is used for an electrophotographic image-forming apparatus. The present invention, however, is not limited thereto. For example, the present invention may be used for an ink-jet image-forming apparatus or another image-forming apparatus other than the electrophotographic image-forming apparatus.

The present invention is not limited to the above embodiments. Various modifications and alterations can be made without departing from the spirit and scope of the present invention. Accordingly, the following claims are attached to make the scope of the present invention public.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A sheet-conveying device comprising:

a first rotary member configured to rotate in one direction;

a second rotary member configured to convey, together with the first rotary member, a sheet in a first direction as a result of rotation of the first rotary member;

a third rotary member configured to convey, together with the first rotary member, the sheet in a second direction as a result of rotation of the first rotary member, wherein the second direction differs from the first direction; and a switching unit configured to switch from a first state to a second state by moving the first rotary member before a trailing end of the sheet that is conveyed in the first direction passes through the first rotary member and the second rotary member, wherein the first state is a state where the second rotary member is in contact with a first surface of the sheet and the first rotary member is in contact with a second surface of the sheet that is opposite the first surface, and wherein the second state is a state where the first rotary member is in contact with the first surface of the sheet and the third rotary member is in contact with the second surface of the sheet.

2. The sheet-conveying device according to claim 1, wherein the switching unit switches from the first state to the second state in a manner in which the first rotary member is moved in a direction in which the first rotary member is separated from one of the following: the second rotary member, the third rotary member, or the second and third rotary members, and wherein, after the first rotary member is separated from one of the second rotary member, the third rotary member, or the second and third rotary members, the first rotary member is moved to a position at which the first rotary member is capable of conveying the sheet together with the second rotary member or the third rotary member.

3. The sheet-conveying device according to claim 2, wherein, when the switching unit moves the first rotary member in the direction in which the first rotary member is separated from one of the second rotary member, the third rotary member, or the second and third rotary members, the second and third rotary members form a holding portion that holds the sheet.

4. The sheet-conveying device according to claim 3, wherein the holding portion holds the sheet with the second rotary member being in contact with the first surface of the sheet and the third rotary member being in contact with the second surface of the sheet.

5. The sheet-conveying device according to claim 4, wherein the switching unit moves the first rotary member to a position at which the first rotary member is in contact with the first surface of the sheet with the sheet held by the holding portion.

6. The sheet-conveying device according to claim 2, wherein, when the switching unit moves the first rotary member in the direction in which the first rotary member is separated from one of the second rotary member, the third rotary member, or the second and third rotary members, the switching unit moves the first rotary member to a position upstream of the trailing end of the sheet that is in contact with the first and second rotary members in the first direction.

7. The sheet-conveying device according to claim 1, further comprising a guiding member configured to guide the sheet that is conveyed, wherein, in a case where the guiding member guides the conveyed sheet, the guiding member moves together with the first rotary member with both ends of the guiding member in a width direction of the sheet that is conveyed being supported by the first rotary member.

8. The sheet-conveying device according to claim 1, wherein, to switch from the first state to the second state when a first sheet and a second sheet conveyed subsequent to the first sheet are conveyed continuously relative to each other, the switching unit moves the first rotary member before a trailing end of the first sheet that is conveyed in the first direction passes through the first and second rotary members, wherein the first state is a state in which the second rotary member is in contact with a first surface of the first sheet and the first rotary member is in contact with a second surface of the first sheet that is opposite the first surface, and wherein the second state is a state in which the first rotary member is in contact with the first surface of the first sheet and the third rotary member is in contact with the second surface of the first sheet, and the first and second rotary members convey the second sheet in the first direction while the first sheet is conveyed in the second direction.

9. The sheet-conveying device according to claim 1, further comprising a drive motor configured to rotate in only one direction, wherein the first rotary member rotates in only one direction when being subjected to a driving force from the drive motor, and the first rotary member continues to rotate while being subjected to the driving force during movement of the first rotary member.

10. The sheet-conveying device according to claim 1, further comprising:

a first urging member configured to urge the second rotary member against the first rotary member; and a second urging member configured to urge the third rotary member against the first rotary member.

11. The sheet-conveying device according to claim 1, wherein rotation of the first rotary member causes the second and third rotary members to rotate.

12. The sheet-conveying device according to claim 1, wherein the second rotary member forms a first nip portion when being in contact with the first rotary member, and the third rotary member forms a second nip portion when being in contact with the first rotary member at a position that differs from a position of the second rotary member in a circumferential direction of the first rotary member.

13. The sheet-conveying device according to claim 1, wherein the first rotary member includes first contact portions configured to come into contact with the sheet in a direction that intersects a direction in which the sheet is conveyed, wherein the second rotary member includes second contact portions that alternate with the first contact portions and are configured to come into contact with the sheet in a direction that intersects the direction in which the sheet is conveyed, and wherein the third rotary member includes third contact portions that face respective second contact portions and are configured to come into contact with the sheet in a direction that intersects the direction in which the sheet is conveyed.

14. The sheet-conveying device according to claim 1, further comprising:

a stack portion on which the sheet that is discharged is to be stacked;

a first conveyance path configured to convey the sheet toward the first rotary member and the second rotary member; and a second conveyance path configured to re-convey, to the first conveyance path, the sheet having been conveyed in the first direction by the first and second rotary members, wherein the first direction is a direction in which the first and second rotary members convey the sheet from the first rotary member toward the stack portion, and the second direction is a direction in which the first rotary member and the third rotary member convey the sheet from the stack portion toward the second conveyance path.

15. An image-forming apparatus comprising:

the sheet-conveying device according to claim 1; and an image-forming unit configured to form an image on a sheet conveyed by the sheet-conveying device.

16. An image-reading apparatus comprising:

the sheet-conveying device according to claim 1; and an image-reading unit configured to read an image on a sheet conveyed by the sheet-conveying device.

17. A sheet-conveying device comprising:

a first rotary member configured to rotate in one direction;

a second rotary member configured to convey, together with the first rotary member, a sheet in a first direction as a result of rotation of the first rotary member; and a third rotary member configured to convey, together with the first rotary member, the sheet in a second direction as a result of rotation of the first rotary member, wherein the second direction differs from the first direction, wherein the first rotary member is movable between a first position and a second position, where the first position is a position of the first rotary member when the first rotary member conveys the sheet together with the second rotary member or the third rotary member, and where the second position is a position of the first rotary member when the first rotary member is separated from one of following: the second rotary member, the third rotary member, or the second and third rotary members, wherein the first rotary member moves from the first position to the second position and, after the first rotary member moves from the first position to the second position, the first rotary member moves from the second position to the first position, and wherein, before the first rotary member moves from the first position to the second position, the second rotary member is in contact with a first surface of the sheet and the first rotary member is in contact with a second surface of the sheet that is opposite the first surface and, after the first rotary member moves from the second position to the first position, the first rotary member is in contact with the first surface of the sheet at the first position.

18. The sheet-conveying device according to claim 17, wherein the first rotary member moves from the first position to the second position before a trailing end of the sheet that is conveyed in the first direction passes through the first and second rotary members.

19. The sheet-conveying device according to claim 17, wherein, when the first rotary member moves from the first position to the second position, the second and third rotary members form a holding portion that holds the sheet, and the holding portion holds the sheet with the second rotary member being in contact with the first surface of the sheet and the third rotary member being in contact with the second surface of the sheet.

20. The sheet-conveying device according to claim 19, wherein, as a result of movement of the first rotary member from the second position to the first position with the sheet held by the holding portion, the first rotary member is in contact with the first surface of the sheet and the third rotary member is in contact with the second surface of the sheet.

21. The sheet-conveying device according to claim 17, further comprising a guiding member configured to guide the sheet that is conveyed, wherein, in a case where the guiding member guides the conveyed sheet, the guiding member moves together with the first rotary member with both ends of the guiding member in a width direction of the sheet that is conveyed being supported by the first rotary member.

22. The sheet-conveying device according to claim 17, wherein, when a first sheet and a second sheet conveyed subsequent to the first sheet are conveyed continuously relative to each other, the first rotary member moves from the first position to the second position with the second rotary member being in contact with a first surface of the first sheet and the first rotary member being in contact with a second surface of the first sheet that is opposite the first surface before a trailing end of the first sheet that is conveyed in the first direction passes through the first and second rotary members and, after the first rotary member moves from the first position to the second position, the first rotary member moves from the second position to the first position and comes into contact with the first surface of the first sheet, and the first and second rotary members convey the second sheet in the first direction while the first sheet is conveyed in the second direction with the third rotary member being in contact with the second surface of the first sheet.

23. The sheet-conveying device according to claim 17, further comprising a drive motor configured to rotate in only one direction, wherein the first rotary member rotates in only one direction when being subjected to a driving force from the drive motor, and the first rotary member continues to rotate while being subjected to the driving force during movement of the first rotary member.

24. The sheet-conveying device according to claim 17, further comprising:

a first urging member configured to urge the second rotary member against the first rotary member; and a second urging member configured to urge the third rotary member against the first rotary member.

25. The sheet-conveying device according to claim 17, wherein rotation of the first rotary member causes the second and third rotary members to rotate.

26. The sheet-conveying device according to claim 17, wherein the second rotary member forms a first nip portion when being in contact with the first rotary member, and the third rotary member forms a second nip portion when being in contact with the first rotary member at a position that differs from a position of the second rotary member in a circumferential direction of the first rotary member.

27. The sheet-conveying device according to claim 17, wherein the first rotary member includes first contact portions configured to come into contact with the sheet in a direction that intersects a direction in which the sheet is conveyed, wherein the second rotary member includes second contact portions that alternate with the first contact portions and are configured to come into contact with the sheet in a direction that intersects the direction in which the sheet is conveyed, and wherein the third rotary member includes third contact portions that face respective second contact portions and are configured to come into contact with the sheet in a direction that intersects the direction in which the sheet is conveyed.

28. The sheet-conveying device according to claim 17, further comprising:

a stack portion on which the sheet that is discharged is to be stacked;

a first conveyance path configured to convey the sheet toward the first rotary member and the second rotary member; and a second conveyance path configured to re-convey, to the first conveyance path, the sheet having been conveyed in the first direction by the first and second rotary members, wherein the first direction is a direction in which the first and second rotary members convey the sheet from the first rotary member toward the stack portion, and the second direction is a direction in which the first rotary member and the third rotary member convey the sheet from the stack portion toward the second conveyance path.

* * * * *